US007477866B2

(12) United States Patent
Itami et al.

(10) Patent No.: US 7,477,866 B2
(45) Date of Patent: Jan. 13, 2009

(54) IMAGE FORMING METHOD AND IMAGE FORMING APPARATUS

(75) Inventors: Akihiko Itami, Hachioji (JP); Kunio Shigeta, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 475 days.

(21) Appl. No.: 11/259,244

(22) Filed: Oct. 26, 2005

(65) Prior Publication Data

US 2006/0120766 A1 Jun. 8, 2006

(30) Foreign Application Priority Data

Nov. 26, 2004 (JP) ..... 2004-342137

(51) Int. Cl.
*G03G 15/09* (2006.01)

(52) U.S. Cl. ..... 399/267; 430/122.1

(58) Field of Classification Search ..... 430/122.1, 430/120.1; 399/267
See application file for complete search history.

(56) References Cited

U.S. PATENT DOCUMENTS

| | | | | |
|---|---|---|---|---|
| 7,081,234 | B1 | 7/2006 | Qi et al. | |
| 2003/0180646 | A1* | 9/2003 | Asano et al. | 430/126 |
| 2006/0019189 | A1* | 1/2006 | Asano et al. | 430/126 |
| 2006/0068307 | A1* | 3/2006 | Itami et al. | 430/58.05 |
| 2006/0093931 | A1 | 5/2006 | Itami | |
| 2006/0115761 | A1 | 6/2006 | Itami | |
| 2006/0166127 | A1 | 7/2006 | Itami | |

FOREIGN PATENT DOCUMENTS

| | | |
|---|---|---|
| JP | 2003241569 | 8/2003 |
| JP | 2003255585 | 9/2003 |
| JP | 2003316036 | 11/2003 |
| JP | 2004004454 | 1/2004 |

* cited by examiner

*Primary Examiner*—John L Goodrow
(74) *Attorney, Agent, or Firm*—Lucas & Mercanti, LLP

(57) ABSTRACT

In an image forming apparatus provided with an organic photoreceptor; a developing device to bring a developing brush in contact with the organic photoreceptor so as to visualize an electrostatic latent image to toner image; a transfer device; and an agent supplying device to provide a surface energy lowering agent to the surface of the organic photoreceptor. The electrostatic latent image is visualized to the toner image while the developing sleeve is rotated in a direction counter to that of the organic photoreceptor at the developing section.

21 Claims, 5 Drawing Sheets

IMAGE FORMING METHOD AND IMAGE FORMING APPARATUS

BACKGROUND OF THE INVENTION

The present invention relates to an image forming method used for the image formation of the electronic photographing method, an image forming apparatus and an organic photoreceptor, and in more detail, to an image forming method used for the image formation of the electronic photographing system used in a field of a copier or a printer, an image forming apparatus and an organic photoreceptor (hereinafter, simply called photoreceptor).

The main subject of a photoreceptor is transferred from an inorganic photoreceptor such as Se, arsenic, arsenic/Se alloy, CdS, ZnO, to an organic photoreceptor which has advantages in the environmental pollution, or easiness of manufacturing, and the organic photoreceptors using various materials are developed.

Recently, the function separation type photoreceptor in which functions for generating the electronic charge and for charge transportation are made in charge to different materials, becomes the main stream, for example, a laminated type photoreceptor in which the charge generating layer, charge transporting layer are laminated through the intermediate layer on the conductive supporting body, is widely used (Patent Document 1).

Further, when looks at the electronic photographic process, in the latent image formation system, it is largely separated into an analog image formation using the halogen lamp as a light source and a digital system image formation using LED or laser as a light source. Recently, as a printer for hard-copy of the personal computer, further, also in the normal copier, from the easiness of the image processing or the easiness of the development to the composite machine, the digital system latent image formation system is rapidly becoming the main stream.

Further, in the digital system image formation method, the opportunity for making the print image of the original is increased, and the requirement for the high quality image is increased. For the high quality image-making of the electronic photographing image, a technology by which the minute latent image formation is conducted by using the light source for exposure whose spot diameter is small, on the organic photoreceptor, and the minute dot image is formed, is developed. For example, by using the light source whose spot diameter is less than 4000 $\mu m^2$, a method by which the high accurate latent image is formed on the organic photoreceptor is well known (Patent Document 2). Even when the high density dot exposure is conducted by such a small diameter spot, the organic photoreceptor by which the high density and uniform latent image can be formed by the dot exposure, and the structure of the developing mode by which the latent image can be reproduced as a toner image, are not yet attained sufficiently. Further, in a dot image, there are problems that a transverse line image becomes thin (a phenomenon in which a one dot line image formed in a direction perpendicular to a paper conveying direction becomes thin in comparison with one dot line image formed in the paper conveying direction), and a trailing edge becomes white omission (a phenomenon in which the image density of a trailing edge portion of a halftone picture image in the paper conveying direction is lowered than the leading edge portion or the trailing edge portion is not developed).

That is, as the developing method of the latent image on the organic photoreceptor, a developing mode by which the developing sleeve oppositely provided to the organic photoreceptor is advanced in parallel with the advancing direction of the organic photoreceptor in the developing area (hereinafter, parallel developing mode), and a developing mode by which the developing sleeve is advanced in the counter direction (hereinafter, counter developing mode) are well known, however, for both, when the high density dot image is formed, the problems can not be solved sufficiently.

In the parallel developing mode by which the developing sleeve oppositely provided to the organic photoreceptor is advanced in parallel with the advancing direction of the organic photoreceptor, the developing property of the periphery of the high density image is deteriorated, and is easily brought to the insufficient density, and in the photographic image whose contrast is high, the image quality is easily deteriorated.

On the one hand, in the counter developing mode by which the developing sleeve is advanced in the counter direction, the developing property is high, and the high density dot image can be formed, however, the fog is often generated, and the insufficient density is easily generated in the leading edge part.

Further, recently, a fine unevenness trouble so called a worm-like unevenness becomes a problem. Although the cause of this worm-like unevenness has not clarified sufficiently, it may be considered that when a relative velocity between a photoreceptor and a developing sleeve becomes faster and a triboelectric charging between a magnetic brush of a developer and a photoreceptor becomes stronger, the worm-like unevenness may occur. For this reason, in comparison with the parallel developing mode, the worm-like unevenness tends to occur in the counter developing mode. Further, the worm-like unevenness has a relative relationship with a frequency of the developing bias such that if the frequency becomes higher, the worm-like unevenness becomes fewer. However, when the frequency becomes higher, there is a tendency that the sharpness of an image becomes lowered. That is, it may be difficult to satisfy both of the reduction of the worm-like unevenness and the sharpness of an image.

The phenomena as described above, are not solved enough simply by only the improvement of the developer, but it is found that also by the characteristic of the organic photoreceptor, these phenomena are deteriorated or improved. That is, it is presumed that these phenomena relate to the contrast of the electro-static latent image formed on the organic photoreceptor, or also to the generation of the inverse charge toner by the rubbing of the organic photoreceptor and the developer.

In the counter development method, due to the contact friction between the photoreceptor and the toner, it is easy for oppositely charged toner to be generated, and as a result, fog or toner splashing can occur, or it is easy for edge section density reductions to occur, and it is not possible to reproduce high resolution electrostatic images as toner images. In other words, although reducing the quantity of oppositely charged toner generated due to the contact friction between the photoreceptor and the toner is considered very important in preventing the occurrence of these fog and edge section density reductions, so far not much research results have been disclosed regarding the surface physics of organic photoreceptors suitable for the counter development method.

[Patent Document 1] Tokkai No. 2003-316203

[Patent Document 2] Tokkai No. 2001-125435

SUMMARY OF THE INVENTION

The present invention relates to an image forming method capable of forming high resolution digital images in a stable manner while solving the above types of problems in the conventional technology, that is, while solving the problem that occurs in the counter development method.

In more specific detail, a purpose of the present invention is to provide an image forming method and an image forming apparatus that can prepare electro-photographic images with high image densities and with good color reproduction while preventing fog or toner splashing that can occur easily in the counter development method and also preventing the occurrence of image striations due to reduction in the edge section densities.

In order to achieve the above objectives of the present invention, that is, to obtain uniform and high resolution electro-photographic images while solving the problems of fog and toner splashing that can occur easily in the counter development method and the problem of occurrence of partial density insufficiencies, the present invention was completed as a result of investigating the relationship between the composition of the developing agent, the composition of the organic photoreceptor, and the development method, and finding out that, in order to prevent fog or toner splashing that can occur easily in the counter development method that has superior development characteristics, and in order to prevent the occurrence of image striations due to reduction in the image edge section densities, it is effective to make smaller the surface energy of the surface layer of the photoreceptor thereby reducing the quantity of oppositely charged toner that is likely to be generated when the photoreceptor and the developing sleeve come into contact with each other.

DETAILED DESCRIPTION OF THE PREFERRED EMBODIMENT

The present invention is described in detail below.

The image forming apparatus according to the present invention has the feature that, in an image forming apparatus that forms an electrostatic latent image on an organic photoreceptor and that comprises a developing means that makes a developing sleeve carrying the developing agent including the toner come into contact with the organic photoreceptor and converts that latent electrostatic image into a visible toner image, and a transfer means that transfers said toner image from the organic photoreceptor to the recording medium, the image forming apparatus has the feature that it has a means for supplying to the surface of the photoreceptor an agent that reduces the surface energy, and the development sleeve is rotated in a counter direction related to the direction of rotation of the organic photoreceptor and is made to come in contact with it, thereby converting the latent electrostatic image into a visible toner image.

Further, the image forming apparatus according to the present invention has the feature that, in an image forming method of forming color images by placing a plural number of image forming units each having a developing means that forms electrostatic latent images on an organic photoreceptor and that makes a developing sleeve carrying the developing agent including the toner come into contact with the organic photoreceptor thereby converting the latent electrostatic image into a visible toner image, and a transfer means that transfers the toner image formed on the organic photoreceptor on to a transfer medium, and forming toner images of different colors on the organic photoreceptors using toners of different colors in each of the plural number of image forming units, and transferring the images of different colors from the organic photoreceptors to the transfer medium, said image forming method has the feature that, the image forming apparatus has a device to supply to the surface of the photoreceptors an agent that reduces the surface energy, and the development sleeve is rotated in a counter direction with respect to the direction of rotation of the organic photoreceptor and is made to come in contact with it, thereby converting the latent electrostatic image into a visible toner image.

By having the above configuration, the image forming method according to the present invention can provide high quality digital images or color images while preventing fog and edge section density insufficiencies that can occur easily in the counter development method. When the line speed of the photoreceptor is 280 mm/sec. or more like a high speed machine, the more preferable result can be obtained.

Figure 2:
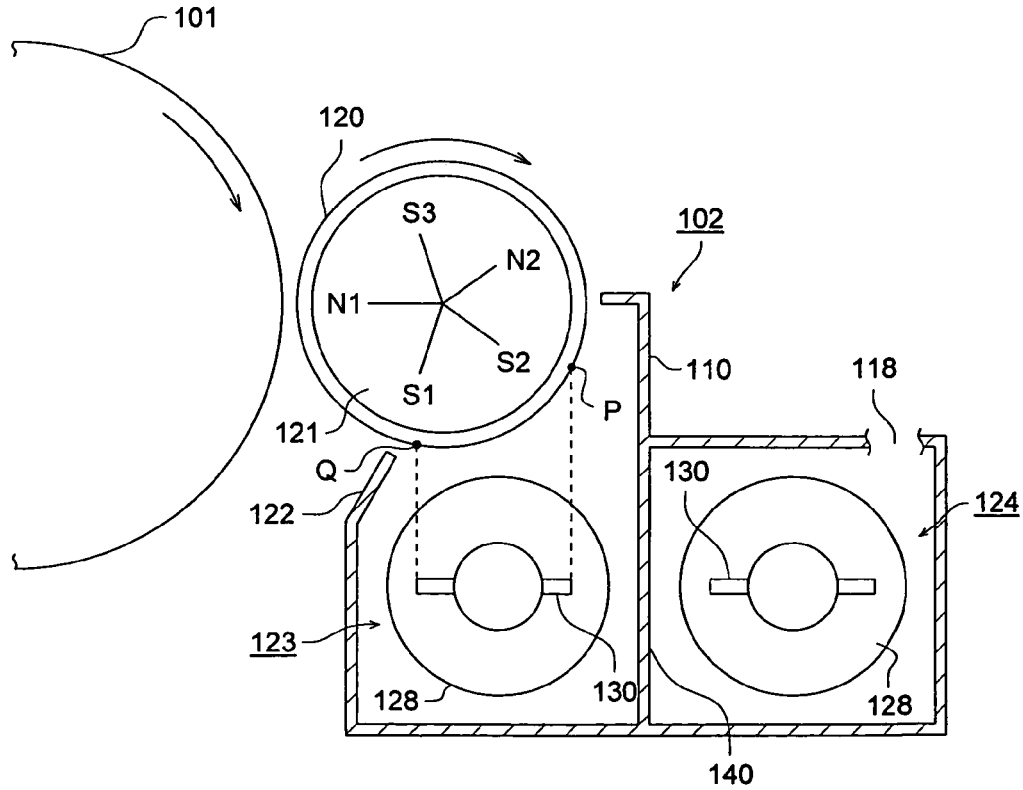
FIG. 2 is a view showing a cross section of a developing device of a counter direction developing method.

Referring to FIG. 2, the developing device of the counter developing mode will be described. Incidentally, the developing device shown in FIG. 2 is a developing device with a contact type two component developing method. However, the invention is not limited to the contact type two component developing method. For example, the invention is applied to a contact type one component developing method. The developing device 102 is arranged in such a manner that, at the opening part of the developing container 110 in which two-component developer is accommodated, the developing sleeve (a developing agent carrying member) 120 in which cylindrical magnet 121 is non-rotationally arranged, is arranged oppositely to the organic photoreceptor (an image carrying member) 101, and this developing sleeve 120 is rotated in the counter direction to the organic photoreceptor 101 rotating in the arrowed direction, and the developer attracted to and held on its surface is conveyed to a developing section opposed to the organic photoreceptor 101. The magnet 121 has the developing magnetic pole N1 on the organic photoreceptor 101 side, and has, from this developing magnetic pole N1 to the rotation direction of the developing sleeve 120, the first conveying magnetic pole S3, the second conveying magnetic pole N2, the third conveying magnetic pole S2 and a draw-up magnetic pole S1 in which the third conveying magnetic pole and a separation magnetic pole are structured.

The developer in the developing container 110 is attracted and held on the developing sleeve 120 by the action of the draw-up pole S1, at the position (draw-up position) Q on the surface of the developing sleeve 120 corresponding to the draw-up magnet pole S1 of the magnet 121, and arrives at the developing section after the layer thickness is regulated by the developing blade (a developing agent layer thickness regulating member) 122, and in the developing section, the magnetic brush (developing brush) is formed by the action of the developing magnetic pole N1, and the latent image on the organic photoreceptor 101 is developed.

The developer whose toner density is lowered by the development, is held on the developing sleeve 120 and returned to the inside of the developing container 110 by the action of the first, second conveying magnet poles S3, N2, and at the position (developer falling position) P on the surface of the developing sleeve 120 whose magnetic flux density is smallest, between the third conveying magnet pole S2 and the draw-up magnet pole S1, it is peeled off from the developing sleeve 120, and is dropped on the developing sleeve from which the developer is peeled off, as described above, the new developer is attracted and held at the draw-up position Q.

Below the developing sleeve 120 in the developing container 110, the first mixing conveying member 123 is provided, and the second mixing conveying member 124 is further provided through the partition wall 140. These first, second mixing conveying members 123, 124 are screw type ones, and have spiral screw blade 128 and plate-like protrusion 130 between collars of its blade.

The developer whose toner density is low, which is peeled off from the developing sleeve 120, drops on the first mixing conveying member 123, and mixing-conveyed by the first mixing conveying member 123 together with the neighboring developer in the axial direction, and passes through the opening, not shown, of the one end portion of the partition wall 140, and it is delivered to the second mixing conveying member 124. The second mixing conveying member 124 conveys the delivered developer and the toner replenished from the replenishing port 118 of the developing container 110 while mixing them, in the rotation direction reverse to the above description, and passing through the opening, not shown, of the other end portion of the partition wall 140, returns them to the first mixing conveying member 123 side.

A preferred embodiment of a counter developing mode is explained. Incidentally, here, a gap between the photoreceptor 101 and the developing sleeve 120 in the developing section neighboring the developing magnet N1 in FIG. 2 is called a developing gap (Dsd), and the height of the magnetic brush formed on the developing sleeve 120 by the developing magnet N1 is called a developing brush height (h).

(1) Developing gap (Dsd): 0.2 to 0.6 mm

When Dsd is made 0.2 to 0.6 mm, the development is conducted under a strong developing electric field and the attraction force to attract magnetic carriers onto the developing sleeve become larger so that the magnetic carriers are prevented from shifting and adhering onto the photoreceptor. Further, the developing electric field in the developing gap becomes higher, an edge effect becomes reduced and a developing ability is enhanced. Therefore, thinning of a transverse line image and a whitening of a trailing edge portion (developing failure at a trailing edge portion) can be prevented and the developing ability for a solid image can be enhanced.

(2) Magnetic brush bent depth (Bsd): 0 to 0.8 mm, here, the magnetic brush bent depth (Bsd) the developing brush height (h)−the developing gap (Dsd)

When the magnetic brush bent depth (Bsd) is made 0 to 0.8 mm, the compression for the developing agent at the developing section is reduced and developing agent is prevented from slipping through a gap between the developing sleeve 120 and the developing blade 122. A developing failure for an isolating dot caused by an uneven contact of a magnetic brush and an increase of a roughness on a halftone image can be prevented. When the magnetic brush bent depth (Bsd) is less than zero, that is, under non contact condition, lowering of a developing density tends to take place. On the other hand, when the magnetic brush bent depth (Bsd) is larger than 0.8 mm, the developing agent flows out from a nip section and a even image formation is not expected.

(3) Peripheral speed ratio of developing sleeve to photoreceptor (Vs/Vopc): 1.2 to 3.0

When the peripheral speed ratio of developing sleeve to photoreceptor (Vs/Vopc) is made 1.2 to 3.0, a high developing ability can be obtained. If the peripheral speed ratio is increased excessively, the contact frequency of magnetic brush on the developing sleeve against the photoreceptor becomes high excessively. Then, the contacting force of the magnetic brush against the photoreceptor, that is, a mechanical force becomes strong excessively and carrier tends to separate away from the magnetic brush and the carrier tends to adhere onto the photoreceptor. As a result, a brush mark is caused on a toner image on the photoreceptor by the magnetic brush. On the contrary, if the peripheral speed ratio is decreased excessively, the contact frequency of magnetic brush on the developing sleeve against the photoreceptor reduces excessively, the developing ability is lowered. Therefore, when the peripheral speed ratio is less than 1.2, the image density becomes low, and when the peripheral speed ratio is larger than 3.0, toner scattering, carrier adhesion, a durability problem of the developing sleeve may take place. In contrast, when the peripheral speed ratio is made within the above range, the brush mark can be prevented. Further, the edge effect is prevented from being enhanced due to an excessive high developing ability.

(4) Developing bias condition

It is desirable that a difference |Vo−Vdc| between the surface electric potential Vo of the photoreceptor and a direct-current component Vdc of a developing bias is made 100 to 300 V, a direct-current component Vdc of a developing bias is made −300 V to −650 V, an alternate current component Vac of the developing bias is made 0.5 to 1.5 KV, frequency is made 3 to 9 KHz, duty ratio is made 45 to 70% (the time ratio of the developing side in a rectangular wave), the shape of the alternate current component is made to be a rectangular wave. Namely, in a small size two component type developing apparatus in which the outer diameter of the developing sleeve is 30 mm or less and the outer diameter of the photoreceptor is 60 mm or less, since a developing nip width becomes small due to the small diameter of the developing sleeve, the developing ability becomes lowered. However, with the above developing bias condition, the lowering of the developing ability can be improved.

Next, a process cartridge and the electronic photographing apparatus according to the present invention will be described. A schematic structure of the electronic photographing apparatus having the process cartridge having the organic photoreceptor of the present invention is shown in FIG. 3.

Figure 3:
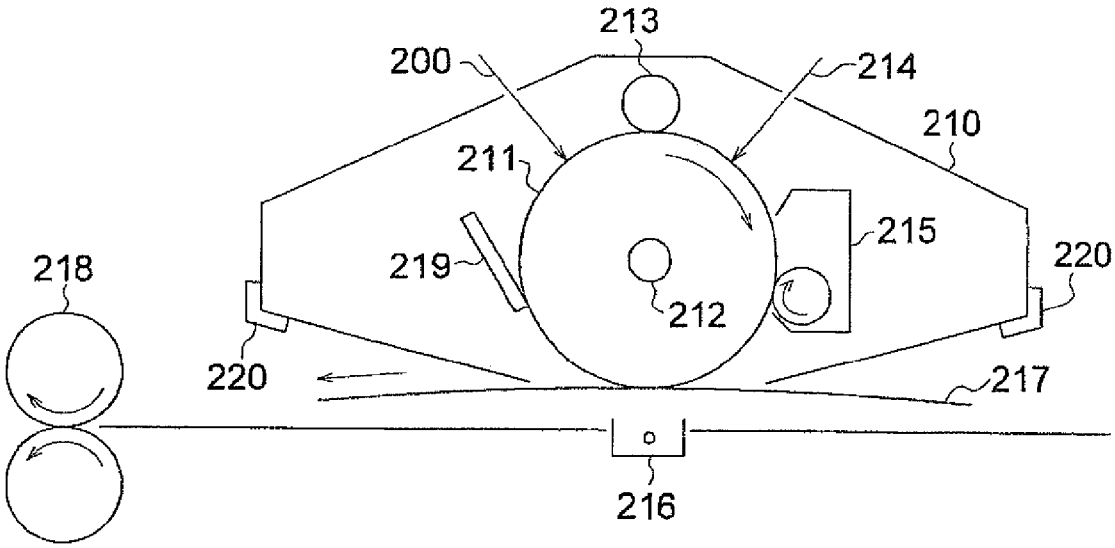
FIG. 3 is a view showing an example of schematic structure of an electronic photographing apparatus having a process cartridge having an organic photoreceptor of the present invention.

In FIG. 3, numeral 11 is a drum-like organic photoreceptor, and is rotated at a predetermined peripheral speed in the arrowed direction around the axis 12. In the rotation process, the organic photoreceptor 11 receives the uniform charging of the positive or negative predetermined potential on its peripheral surface by the primary charging means 13, next, receives the emphasized and modulated exposure light 14 corresponding to the time series electric digital image signal of the image information for the purpose that it is outputted from the exposure means (not shown) such as a slit exposure or laser beam scanning exposure. In this manner, on the peripheral surface of the organic photoreceptor 11, electrostatic latent images corresponding to a target image information are successively formed.

The formed electrostatic latent image is next toner-developed by the developing means 15, and onto the transfer material 17 which is taken out and fed from the sheet feeding section, not shown, in timed relationship with the rotation of the organic photoreceptor 11 between the organic photoreceptor 11 and the transfer means 16, the toner images which are formed and held on the surface of the organic photoreceptor 11, are successively transferred by the transfer means 16.

The transfer material 17 onto which the toner image is transferred, is separated from the surface of the organic photoreceptor and when it is introduced into the image fixing means 18 and image-fixed, printed out to the outside of the apparatus as the image formed material (print, copy).

The surface of the organic photoreceptor 11 after the image transferring, is cleaned when the remained toner of the transferring is removed by the cleaning means 19, and further after the surface is discharging-processed by the pre-exposure light 20 from the pre-exposure means (not shown), it is repeatedly used for the image formation. Hereupon, when the primary charging means 13 is a contact charging means using the charging roller, the pre-exposure is not always necessary.

In the present invention, in the components such as the above organic photoreceptor 11, primary charging means 13, developing means 15 and cleaning means 19, a plurality ones are accommodated in a casing 21 and structured by being integrally combined as a process cartridge, and this process cartridge may also be detachably structured for the electronic photographing apparatus main body such as the copier or laser beam printer. For example, at least one of the primary charging means 13, developing means 15 and cleaning means 19, is integrally supported with the organic photoreceptor 11 and made into the cartridge, and by using the guiding means 22 such as rails of the apparatus main body, it can be made a process cartridge which is detachable for the apparatus main body.

Further, an embodiment of a printer of the electronic photographing system (hereinafter, simply called printer) as the full-color image forming apparatus to which the present invention is applied, will be described bellow.

Figure 4:
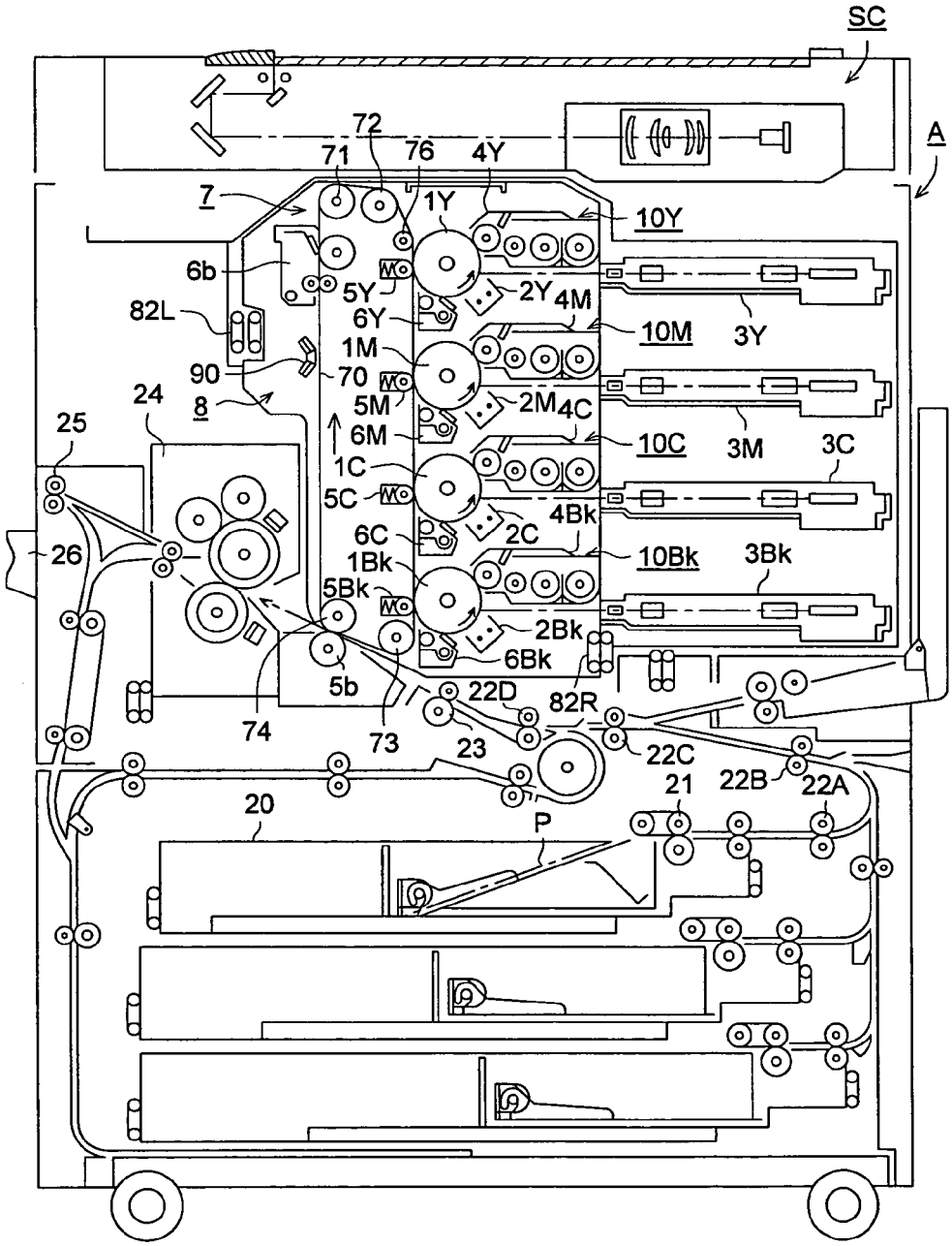
FIG. 4 is a schematic structural view of a color image forming apparatus of an example of the present invention.

FIG. 4 is a cross-sectional configuration view diagram of a color image forming apparatus showing a preferred embodiment of the present invention.

This color image forming apparatus is of the so called tandem type color image forming apparatus, and comprises four sets of image forming sections (image forming units) 10Y, 10M, 10C, and 10Bk, an endless belt shaped intermediate image transfer body unit 7, a sheet feeding and transportation means 21, and a fixing means 24. The original document reading apparatus SC is placed on top of the main unit A of the image forming apparatus.

The image forming section 10Y that forms images of yellow color comprises a charging means (charging process) 2Y, an exposing means (exposing process) 3Y, a developing means (developing process) 4Y, a primary transfer roller 5Y as a primary transfer means (primary transfer process), and a cleaning means 6Y all placed around the drum shaped photoreceptor 1Y which acts as the first image supporting body. The image forming section 10M that forms images of magenta color comprises a drum shaped photoreceptor 1M which acts as the first image supporting body, a charging means 2M, an exposing means 3M, a developing means 4M, a primary transfer roller 5M as a primary transfer means, and a cleaning means 6M. The image forming section 10C that forms images of cyan color comprises a drum shaped photoreceptor 1C which acts as the first image supporting body, a charging means 2C, an exposing means 3C, a developing means 4C, a primary transfer roller 5C as a primary transfer means, and a cleaning means 6C. The image forming section 10Bk that forms images of black color comprises a drum shaped photoreceptor 1Bk which acts as the first image supporting body, a charging means 2Bk, an exposing means 3Bk, a developing means 4Bk, a primary transfer roller 5Bk as a primary transfer means, and a cleaning means 6Bk.

Said four sets of image forming units 10Y, 10M, 10C, and 10Bk are constituted, centering on the photoreceptors 1Y, 1M, 1C, and 1Bk, by the rotating charging means 2Y, 2M, 2C, and 2Bk, the image exposing means 3Y, 3M, 3C, and 3Bk, the rotating developing means 4Y, 4M, 4C, and 4Bk, and the cleaning means 6Y, 6M, 6C, and 6BK that clean the photoreceptors 1Y, 1M, 1C, and 1Bk.

Said image forming units 10Y, 10M, 10C, and 10Bk, all have the same configuration excepting that the color of the toner image formed in each unit is different on the respective photoreceptors 1Y, 1M, 1C, and 1Bk, and detailed description is given below taking the example of the image forming unit 10Y.

The image forming unit 10Y has, placed around the photoreceptor 1Y which is the image forming body, a charging means 2Y (hereinafter referred to merely as the charging unit 2Y or the charger 2Y), the exposing means 3Y, the developing means 4Y, and the cleaning means 6Y (hereinafter referred to merely as the cleaning means 6Y or as the cleaning blade 6Y), and forms yellow (Y) colored toner image on the photoreceptor 1Y. Further, in the present preferred embodiment, at least the photoreceptor 1Y, the charging means 2Y, the developing means 4Y, and the cleaning means 6Y in this image forming unit 10Y are provided in an integral manner.

The charging means 2Y is a means that applies a uniform electrostatic potential to the photoreceptor 1Y, and a corona discharge type of charger unit 2Y is being used for the photoreceptor 1Y in the present preferred embodiment.

The image exposing means 3Y is a means that carries out light exposure, based on the image signal (Yellow), on the photoreceptor 1Y to which a uniform potential has been applied by the charging means 2Y, and forms the electrostatic latent image corresponding to the yellow color image, and an array of light emitting devices LEDs and imaging elements (product name: SELFOC LENSES) arranged in the axial direction of the photoreceptor 1Y or a laser optical system etc., is used as this exposing means 3Y.

In the image forming method, in the time of forming an electrostatic latent image on a photoreceptor, it is desirable that to perform image-wise exposure with a light exposure beam having a spot area of 2000 $\mu m^2$ or less. Even if conducting image-wise exposure with such a light exposure beam of a small diameter, the organic photoreceptor according to the present invention can form faithfully a picture image corresponding to the spot area. The more preferable spot area is 100 to 1000 $\mu m^2$. As a result, an electrophotography picture image having a good gradation can be formed with 800 dpi (dpi: the number of dots per 25.4 cm) or more.

When a light exposure beam is cut along a plane perpendicular to the beam, the spot area of the light exposure beam means an area corresponding to the region in which the intensity of the exposure beam is $1/e^2$ or more times the peak intensity in a light intensity distribution surface which appears in the sectional plane.

The optical beams used can be a scanning optical system using a semiconductor laser or a fixed scanner using LEDs, etc. The light intensity distribution can be Gaussian distribution or Lorentz distribution, and in either case, the area with a light intensity of $1/e^2$ or more than the peak intensity is considered as the spot area according to the present invention.

The intermediate image transfer body unit 7 in the shape of an endless belt is wound around a plurality of rollers, and has an endless belt shaped intermediate image transfer body 70 which acts as a second image carrying body in the shape of a partially conducting endless belt which is supported in a free to rotate manner.

The images of different colors formed by the image forming units 10Y, 10M, 10C, and 10Bk, are successively transferred on to the rotating endless belt shaped intermediate image transfer body 70 by the primary transfer rollers 5Y, 5M, 5C, and 5Bk acting as the primary image transfer means, thereby forming the synthesized color image. The transfer material P as the transfer material stored inside the sheet feeding cassette 20 (the supporting body that carries the final fixed image: for example, plain paper, transparent sheet, etc.,) is fed from the sheet feeding means 21, pass through a plurality of intermediate rollers 22A, 22B, 22C, and 22D, and the resist roller 23, and is transported to the secondary transfer roller 5*b* which functions as the secondary image transfer means, and the color image is transferred in one operation of secondary image transfer on to the transfer material P. The transfer material P on which the color image has been transferred is subjected to fixing process by the fixing means 24, and is gripped by the sheet discharge rollers 25 and placed above the sheet discharge tray 26 outside the equipment. Here, the transfer supporting body of the toner image formed on the photoreceptor of the intermediate transfer body or of the transfer material, etc. is comprehensively called the transfer media.

On the other hand, after the color image is transferred to the transfer material P by the secondary transfer roller 5b functioning as the secondary transfer means, the endless belt shaped intermediate image transfer body 70 from which the transfer material P has been separated due to different radii of curvature is cleaned by the cleaning means 6*b* to remove all residual toner on it.

During image forming, the primary transfer roller 5Bk is at all times pressing against the photoreceptor 1Bk. Other primary transfer rollers 5Y, 5M, and 5C come into pressure contact respectively with their corresponding photoreceptor 1Y, 1M, and 1C only during color image forming.

The secondary transfer roller 5*b* comes into pressure contact with the endless belt shaped intermediate transfer body 70 only when secondary transfer is to be made by passing the transfer material P through this.

Further, the chassis 8 can be pulled out via the supporting rails 82L and 82R from the body A of the apparatus.

The chassis 8 comprises the image forming sections 10Y, 10M, 10C, and 10Bk, and the endless belt shaped intermediate image transfer body unit 7.

The image forming sections 10Y, 10M, 10C, and 10Bk are arranged in column in the vertical direction. The endless belt shaped intermediate image transfer body unit 7 is placed to the left side in the figure of the photoreceptors 1Y, 1M, 1C, and 1Bk. The endless belt shaped intermediate image transfer body unit 70 comprises the endless belt shaped intermediate image transfer body 70 that can rotate around the rollers 71, 72, 73, and 74, the primary image transfer rollers 5Y, 5M, 5C, and 5Bk, and the cleaning means 6*b*.

Figure 5:
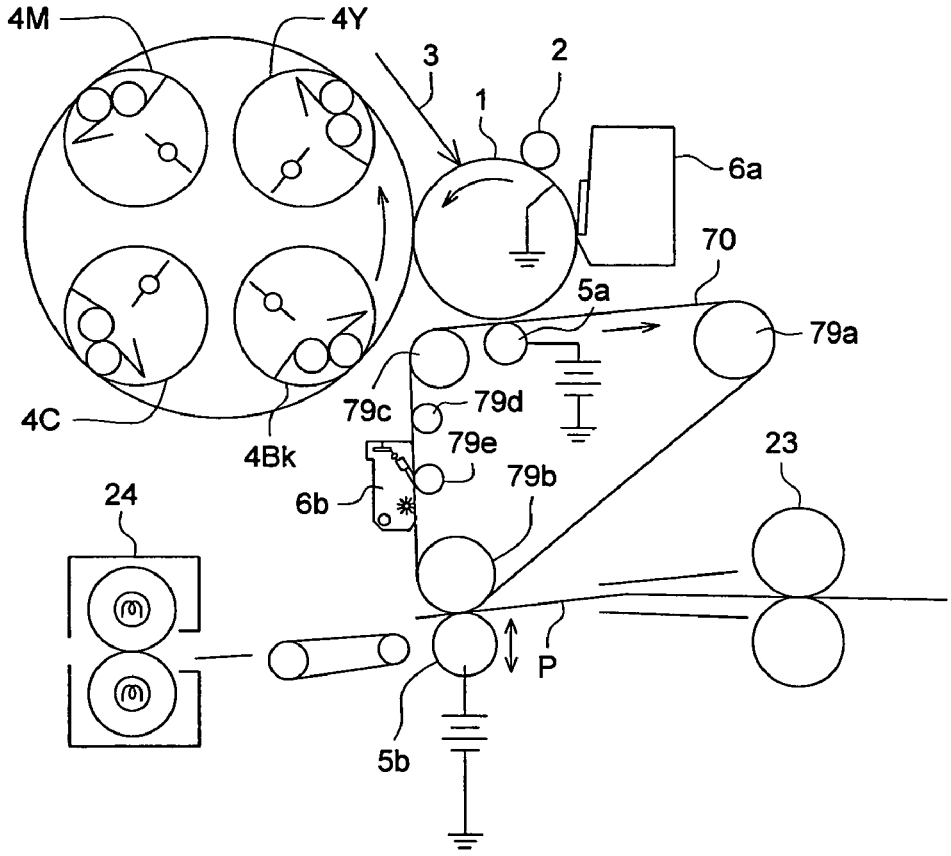
FIG. 5 is a schematic structural view of a color image forming apparatus employing an organic photoreceptor of the present invention.

Next, FIG. 5 shows the cross-sectional configuration view diagram of a color image forming apparatus using an organic photoreceptor according to the present invention (a copier or a laser beam printer having at least a charging means, an exposing means, a plurality of developing means, image transfer means, cleaning means, and intermediate image transfer body around the organic photoreceptor). An elastic material with a medium level of electrical resistivity is being used for the belt shaped intermediate image transfer body 70.

In this figure, 5 is a rotating drum type photoreceptor that is used repetitively as the image carrying body, and is driven to rotate with a specific circumferential velocity in the anti-clockwise direction shown by the arrow.

During rotation, the photoreceptor 1 is charged uniformly to a specific polarity and potential by the charging means (charging process) 2, after which it receives from the image exposing means (image exposing process) 3 not shown in the figure image exposure by the scanning exposure light from a laser beam modulated according to the time-serial electrical digital pixel signal of the image information thereby forming the electrostatic latent image corresponding to the yellow (Y) color component (color information) of the target color image.

Next, this electrostatic latent image is developed by the yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on the photoreceptor 1, and the yellow toner image of the above first color does not get affected by the above second to fourth developers.

The intermediate image transfer body 70 is wound over the rollers 79*a*, 79*b*, 79*c*, 79*d*, and 79*e* and is driven to rotate in a clockwise direction with the same circumferential speed as the photoreceptor 1.

The yellow toner image of the first color formed and retained on the photoreceptor 1 is, in the process of passing through the nip section between the photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 5*a* to the intermediate image transfer body 70.

The surface of the photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the photoreceptor 1 to the intermediate image transfer body 70, the secondary transfer roller 5*b* and the intermediate image transfer body cleaning means 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing means 24 and is heated and fixed there.

An embodiments of an image forming apparatus of the present invention comprises a device to supply a surface energy reducing agent to a surface of a photoreceptor. The supplying device can be disposed at any appropriate positions around the photoreceptor. The supplying device can be also disposed at position using a part of any of a charging means, developing means and a cleaning means as shown in FIGS. 2 to 5. The example of the supplying device using a part of the cleaning means is shown.

Figure 6:
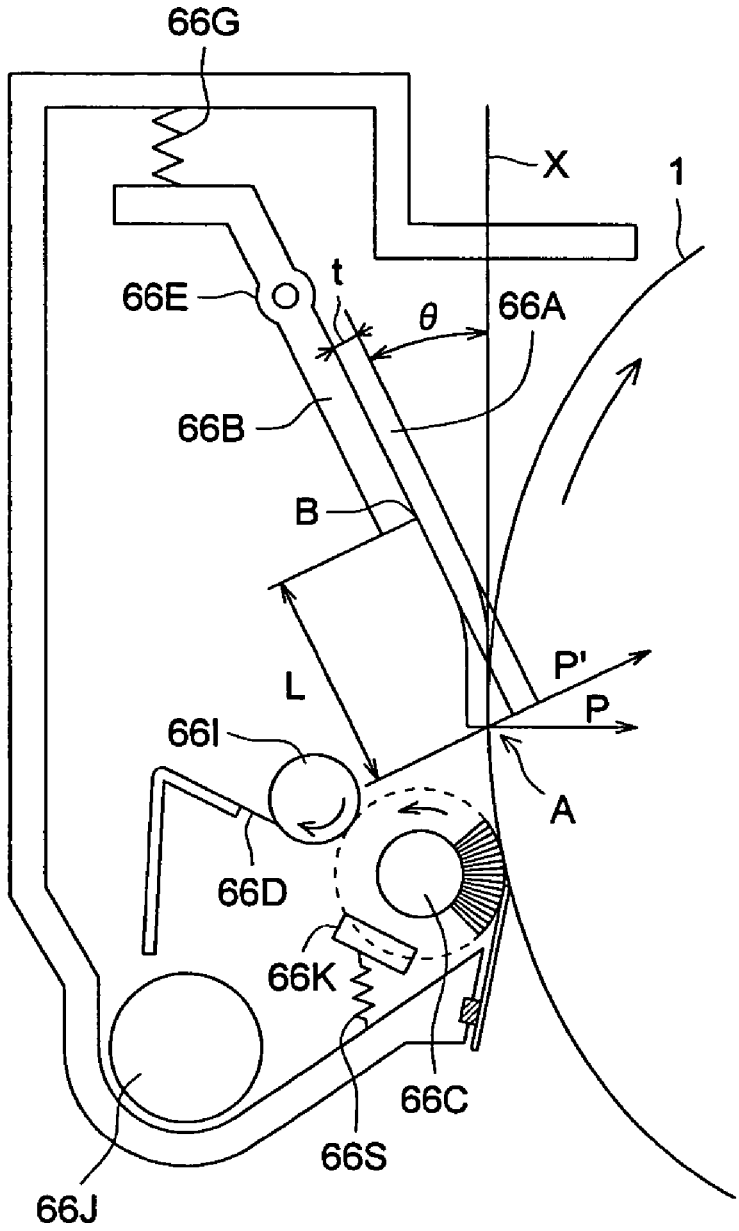
FIG. 6 is a schematic structural view of a cleaning means of the present invention.

FIG. 6 shows a schematic view of an example of a cleaning means according to the present invention.

This cleaning device is used as a cleaning device of 6Y, 6M, 6C, 6K, and the like, in FIG. 6. Cleaning blade 66A in FIG. 6 is fitted to supporting member 66B. As the material of the cleaning blade, a rubber elastic body is employed. Specifically, for the material, there are known urethane rubber, silicone rubber, fluorine-containing rubber, chloropyrene caoutchouc, butadiene rubber, wherein urethane rubber is particularly preferable because of excellent friction characteristic compared with other rubbers.

On the other hand, supporting member 66B is constructed by a plate shape metal material or plastic material. As a metal material, a stainless steel plate, aluminum plate, or an earthquake resistant steel plate is preferable.

The tip of the cleaning blade that is pressed against the surface of the photoreceptor in contact therewith is preferably pressed in the state that a load is applied in the direction (counter direction) opposite to the rotation of the photoreceptor. As shown in FIG. 6, the tip of the cleaning blade preferably forms a pressure contact plane when it contacts with the photoreceptor with pressure.

Preferable values of contact load P and contact angle θ are respectively P=5 to 40 N/m and θ=5 to 35 degrees.

The contact load P is a vector value, in the normal direction, of press load P' during when cleaning blade 66A is in press contact with photoreceptor drum 1.

The contact angle θ is an angle between tangent X of the photoreceptor at contact point A and the blade (shown by a dotted line) having not yet been displaced. Numeral 66E represents a rotation shaft that allows the supporting member to rotate, and 66G represents a load spring.

Free length L of the cleaning blade represents, as shown in FIG. 6, the distance between the position of edge B of the supporting member 66B and the tip point of the blade having not yet been displaced. A preferable value of the free length L is in the range from 6 to 15 mm. Thickness t of the cleaning blade is preferably in the range from 0.5 to 10 mm. The thickness of the cleaning blade herein is in the octagonal direction with respect to surface adhering to the supporting member 66B.

Brush roll 66C is employed as the cleaning device in FIG. 6 which also serves as the agent supply device.

The brush roll has functions of removing toner adhering to the photoreceptor 1 and recovering the toner removed by the cleaning blade 66A as well as a function as an agent supply device for supply of surface energy lowering agent to the photoreceptor. That is, the brush roll contacts with the photoreceptor 1, rotates in the same direction with the rotation of the photoreceptor at a contact part thereof, removes toner and paper particles on the photoreceptor, conveys toner removed by the cleaning blade 66A, and recovers the removed toner and paper particles to conveying screw 66J.

Regarding the path herein, it is preferable that flicker 66I as removing means is contacted with the brush roll 66C, thereby removing the removed such as the toner which has been transferred from the photoreceptor 1 to the brush roll 66C.

Further, the toner deposited to the flicker is removed by scraper 66D and recovered into the conveying screw 66J. The recovered toner is taken out outside as waste or conveyed to a developing vessel through a recycle pipe (not shown) for recycling toner to be reused. As a material of the flicker 66I, metal pipes of stainless steel, aluminum, etc. are preferably used. As the scraper 66D, it is preferable that an elastic plate such as phosphor-bronze plate, polyethylene terephthalate board, polycarbonate plate is employed, and the tip thereof is contacted with the flicker by a counter method in which the tip forms an acute angle with respect to the rotation direction of the flicker.

Surface energy lowering agent (solid material of zinc stearate) 66K is pressed by spring load 66S to be fitted to the brush roll, and the brush rubs the surface energy lowering agent while rotating to supply the surface energy lowering agent to the surface of the photoreceptor.

As the brush roll 66C, a conductive or semiconductive brush roll is employed.

An arbitrary material can be used as the material of the brush of the brash roll, however, a fiber forming high molecular polymer having a high dielectric constant is preferable. As such a high molecular polymer, for example, rayon, nylon, polycarbonate, polyester, a methacrylic acid resin, acryl resin, polyvinylchloride, polyvinylidene chloride, polypropylene, polystyrene, polyvinyl acetate, styrene-butadiene copolymer, vinylidene chloride-acrylonitrile copolymer, chloroethylene-acetic acid vinyl copolymer, chloroethylene-vinyl acetate-maleic anhydride copolymer, silicone resin, silicone-alkyd resin, phenol-formaldehyde resin, styrene-alkyd resin, polyvinylacetal (for example, polyvinylbutyral) may be usable. These binder resins can be used solely or in a mixture of each other in two or more high molecular polymers.

Preferably, rayon, nylon, polyester, acryl resin, polypropylene may be usable.

As the brush, a conductive or semiconductive brush is employed, wherein the brush is prepared by providing a low resistance material such as carbon into a material of the brush and adjusting the specific resistance of the material of the brush to an arbitrary value.

The specific resistance of a brush bristle of the brush roll is preferably in the range from $10^1$ to $10^6$ Ωcm when measured in the state that a voltage of 500 volts is applied to both ends of a piece of brush bristle with a length of 10 cm at a normal temperature and humidity (temperature 26° C., humidity 50%).

The brush roll is preferably comprised of a stem of stainless steel or the like and conductive or semiconductive brush bristles having a specific resistance in the range from $10^1$ to $10^6$ Ωcm. In this range, banding or the like due to electric discharge and cleaning defects hardly occur.

A brush bristle for the brush roll preferably has a thickness in the range from 5 to 20 denier. In this range, surface deposits can be removed well by an enough rubbing force, and further, the surface of the photoreceptor is not damaged much, which achieves a long life of the photoreceptor.

The value in "denier" herein is the value of mass of a 9000 m long brush bristle (fiber) measured in grams, the brush bristle constructing the brush.

The density of the brush bristles of the brush is in the range from $4.5\times10^2/cm^2$ to $2.0\times10^4/cm^2$ (number of brush bristles per $cm^2$). In this range, it is possible to uniformly remove deposits, prevent the photoreceptor from abrasion, and prevent image defects such as fogging due to drop in sensitivity and black streaks due to scratches.

The depth of piercing of the brush roll into the photoreceptor is preferably set within the range 0.4 to 1.5 mm, more preferably 0.5 to 1.2 mm. This depth of piercing is equivalent to the load caused by a relative motion between the drum of the photoreceptor and the brush roll and applied to the brush. This load corresponds to the rubbing force applied by the brush, in a viewpoint of the photoreceptor.

This depth of piercing is defined by a length of piercing into the photoreceptor with an assumption that a brush bristle goes linearly inside the photoreceptor without curving on the surface of the photoreceptor when the brush contacts with the photoreceptor.

Since the rubbing force of the brush on the surface of the photoreceptor being provided with a surface energy lowering agent is weak, if the depth of piercing of the brush roll into the photoreceptor is set within the range from 0.4 to 1.5 mm, it is possible to reduce filming of paper particles and the like onto the surface of the photoreceptor, prevent defects such as irregularities on the image, and prevent occurrence of fogging due to drop in sensitivity, scratches on the surface of the photoreceptor, and streaking defects on the image.

As the stem of a roll part to be used as a brush roll, metals such as stainless steel and aluminum, paper, plastics are mostly used, but not limited to these.

The brush roll is provided with a brush through a sticking layer on the surface of a cylindrical stem. This situation is preferable.

The brush roll preferably rotates such that a contact part thereof moves in the same direction as that of the motion of the surface of the photoreceptor. If the contact part moves in the opposite direction, and there is excessive toner on the surface of the photoreceptor, toner removed by the brush roll may spill out and dirty the recording sheet and the apparatus.

In the motion of the photoreceptor and the brush roll in the same direction as described above, the surface velocity ratio between them is in the range from 1:1 to 1:2. This situation is preferable. If the rotation speed of the brush roll is smaller than that of the photoreceptor, the toner removal performance of the brush roll is reduced, thus cleaning defects easily occur, and if the rotation speed of the brush roll is greater than that of the photoreceptor, the toner removal performance is excessive to cause blade bounding or curving.

In an image forming apparatus, as stated above, provided with an intermediate transfer member, it is preferable that agent supplying means for providing a surface energy lowering agent with a water content ratio of 5.0 weight percent or lower on the surface of an electrophotographic photoreceptor is in contact with the surface of the electrophotographic photoreceptor.

Here, a surface energy lowering agent is a substance that adheres to the surface of a photoreceptor and lowers the surface energy of the photoreceptor, and more specifically, a material that increases the contact angle (contact angle with respect to deionized water) of the surface of the photoreceptor in a degree equal to or greater than 1 degree by adhering to the surface.

Measurement of Surface Contact Angle

The contact angle of the surface of the photoreceptor is measured with respect to deionized water with a contact angle meter (model CA-DT.A manufactured by Kyowa Interface Science Co., Ltd.) in an environment of 30° C. and RH 80%.

As a surface energy lowering agent, it is not limited to materials of fatty acid metal salt or a fluororesin, and any material can be applied as long as the material increases the contact angle (contact angle with respect to deionized water) of the surface of an electrophotographic photoreceptor in a degree equal to or greater than one degree.

As a surface energy lowering agent, fatty acid metal salt is most preferable because of extendibility on the surface of a photoreceptor and performance of forming a uniform layer. As for the fatty acid metal salt, saturated or unsaturated fatty acid metal salt having carbon number of 10 or more is preferable. For example, aluminum stearate, stearic acid indium, stearic acid gallium, zinc stearate, lithium stearate, magnesium stearate, sodium stearate, pal thymine acid-aluminium, aluminium oleate may be usable. More preferably, metal stearate may be usable.

Among the above fatty acid metal salt, fatty acid metal salt with a particularly high outflow rate measured by a flow tester is highly cleavage and capable of effectively forming a layer of fatty acid metal salt on the surface of a photoreceptor. The outflow rate is preferably in the range from $1\times10^{-7}$ to $1\times10^{-1}$, and most preferably from $5\times10^{-4}$ to $1\times10^{-2}$. The outflow rate was measured employing Shimadzu Flowtester "CFT-500" (manufactured by Shimadzu Corporation).

A fluorine resin powder such as polytetrafluoroethylene, polyvinylidene fluoride, is preferable for an other example of the solid material.

It may be desirable that these solid material pressures is used in a plate shape or a bar shape by being applied with pressure as necessary.

Next, the configuration of the organic photoreceptor is described here.

In the present invention, the term organic photoreceptor means an electro-photographic photoreceptor constituted using an organic chemical compound having at least one of the functions of charge generation and charge transportation which functions are absolutely necessary for constituting a photoreceptor, and includes all known organic photoreceptors such as photoreceptors constituted out of known organic charge generating materials or organic charge transporting materials, photoreceptors in which the electric charge generation and charge transportation functions are constituted out of a polymer complex, etc.

The surface layer of the photoreceptor of the present invention is made to include inorganic particles with number average primary particle diameters in the range of 3 to 150 nm. By including inorganic particles with the number average primary particle diameters in the range of 3 to 150 nm in the surface layer, it is possible to spread uniformly on the surface of the photoreceptor the surface energy lowering agent supplied from the agent applying means, to lower the surface energy of the organic photoreceptor, to lower the contact friction between the photoreceptor and the developing sleeve that can occur easily in the counter development method, to reduce the generation of oppositely charged toner, to prevent the generation of fog or image striations due to edge part density variations, to prevent also toner splashing, etc., and to form electro-photographic images with high densities and good color reproduction.

It is desirable that the photoreceptor of the present invention has a surface layer that includes inorganic particles with number average primary particle diameters in the range of 3 to 150 nm, and also that has the surface roughness Ra in the range of 0.001~0.018.

The surface roughness Ra (hereinafter referred to merely as Ra) and the 10-point surface roughness Rz (hereinafter referred to merely as Rz) are described here (same as "ten-point height of irregularities" in the JIS B 0601 standard).

In the present invention, Ra is expressed as the value in micrometers (μm) obtained using the following equation, when only a reference length part of the roughness curve is extracted in the direction of its average line, the X-axis is taken along the direction of the average line of this extracted part, the Y-axis is taken in the direction of the vertical magnification, and the roughness curve is expressed by y=f(x).

Equation 1:

$$Ra = \frac{1}{L}\int_0^L |f(x)|dx$$

Where, L is the reference length, which is 2.5 mm in the present invention, and the cutoff value is 0.08 mm.

The measurements were made using a surface roughness measuring instrument (Surfcorder SE-30H, manufactured by Kosaka Laboratory Ltd.). However, it is possible to use any other measuring instrument as long as that instrument can give the same results within the tolerance range.

Surface Roughness Measurement Conditions:

Measurement speed (Drive speed): 0.1 mm/s

Measurement stylus diameter: 2 μm

The surface layer in the present invention is the layer that comes into contact with air in an organic photoreceptor formed with a layered structure, and this layer can also be a protective layer by its function, or a charge transport layer, or can be a layer having other functions.

As the inorganic particles in the present invention, it is desirable to use metal oxides (including transition metal oxides) such as silica, titanium oxide, zinc oxide, alumina, etc. Among these, silica, titanium oxide, and alumina are used desirably.

In the present invention, inorganic particles with a number average primary particle diameter in the range of 3.0 to 150 nm can be used. In particular, it is desirable to use particles with a number average primary particle diameter in the range of 5 nm to 100 nm. The number average primary particle diameter is the measured value obtained by observing randomly selected 100 fine particles as the primary particles using a transmission electron microscope under a magnification of 10,000 and computing their average diameter in the Feret direction by image analysis.

It is difficult to distribute evenly inorganic particles with number average primary particle diameters of less than 3.0 nm in the surface layer but agglomerated particles are formed easily, Ra is likely to become larger than the range mentioned above, the contact friction between the photoreceptor and the developing agent becomes larger, the generation of oppositely charged toner increases, and in the counter development method, fog is caused easily, toner splashing is increased, or edge part density reduction occurs. On the other hand, inorganic particles with number average primary particle diameters of more than 150 nm are likely to create large undulations on the surface of the surface layer, Ra is likely to become larger than the range mentioned above, and similarly in the counter development method, fog is caused easily, toner splashing is increased, or edge part density reduction occurs.

Further, when the surface roughness Ra is less than 0.001, it is difficult to introduce the inorganic particles in an effective quantity in the surface layer of the photoreceptor, the wear resistance of the photoreceptor becomes insufficient, and in the counter development method, abrasion damages occur easily in the surface layer, and end part density reduction becomes easy to occur in halftone images.

In addition, as the inorganic particles introduced in the surface layer, it is desirable to use inorganic particles with a degree of hydrophobicity of 50 as defined below and with a distribution of hydrophobicity of 25 by carrying out surface treatment.

In other words, since these inorganic particles have a plurality of hydroxyl radicals on the surface, although it is known to make the degree of hydrophobicity high by closing these hydroxyl radical links, in the present invention, in order to effectively prevent the generation of fog or edge part density reductions in the counter development method, it was found out that it is desirable to use inorganic particles in which not only the degree of hydrophobicity indicating the average level of closing these hydroxyl radicals to a value more than 50 but also to control the hydrophobicity distribution value to less than 25. By using such inorganic particles, it is possible to prevent the generation of fog or edge part density reductions, and to form good electro-photographic images with high durability and sharpness.

When the degree of hydrophobicity of inorganic particles is less than 50, a large number of hydroxyl radicals would be present at the surface of the inorganic particles, the dependency on humidity of the electric potential characteristics (charging potential or residual potential) will be large, and it is easy for fog or edge part density reductions to occur. It is still more desirable that the hydrophobicity of inorganic particles is 55 or more. In addition, in order to made the hydrophobicity equal to or more than 95% of inorganic particles such as silica or titanium oxide that have a large number of hydroxyl radicals on the surface, it is necessary to close almost 100 % of these hydroxyl radicals by carrying out surface treatment, but it is not practicable because the production cost becomes high. It is more desirable to make the hydrophobicity equal to 90% or less from the point of view of production cost and practicability.

Further, if the hydrophobicity distribution value is more than 25, inorganic particles with a large number of residual hydroxyl radicals on the surface will be present, and it becomes easy for fog or edge part density reductions to occur.

Further, said degree of hydrophobicity (methanol wettability) is expressed as the degree of wettability with methanol. That is, it is defined as follows.

$$\text{Hydrophobicity(methanol wettability)} = (a/(a+50)) \times 100$$

The method of measuring hydrophobicity is described below.

Measure 0.2 g of the measurement target inorganic particles in 50 ml distilled water put inside a beaker with 200 ml capacity. Slowly deliver methanol in drops from a burette whose tip is immersed in the liquid while stirring, so that all the inorganic particles are wetted (until all of them settle down) to the bottom of the container. When the volume of methanol required for completely wetting the inorganic particles is taken as a (ml), the hydrophobicity is calculated according to the above equation.

Method of measuring the hydrophobicity distribution:

1) Measure 0.2 g of the measurement target inorganic particles in place in a spinning tube.

(Prepare a number of tubes equal to the number of points to be plotted plus 1 (for total sedimentation).)

2) Put 7 ml methanol solution with different concentrations in each of the tubes using a Komagome pipette, and close them tightly (use the methanol density determined from the above hydrophobicity in the case of the tube for measuring full settlement).

3) Disperse them for 30 seconds at 90 rpm using a turbular mixer.

4) Place them in a centrifuge (for 10 minutes at 3500 rpm, 18.1 cm of rotor radius).

5) Read out the settled volume, and obtain each of the settled volumes as percentages taking the volume of full settlement as 100% (the volume when all particles settle down).

6) Based on each of the above measured values, plot a graph with the methanol volume (Vol %) along the horizontal axis and the settlement volume (%) along the vertical axis.

The hydrophobicity distribution is calculated from the above measurements.

The hydrophobicity distribution being less than 25 is defined as follows.

{(Methanol Vol % for 100% settlement volume)−(methanol Vol % for 10% settlement volume)}≦25

Figure 1:
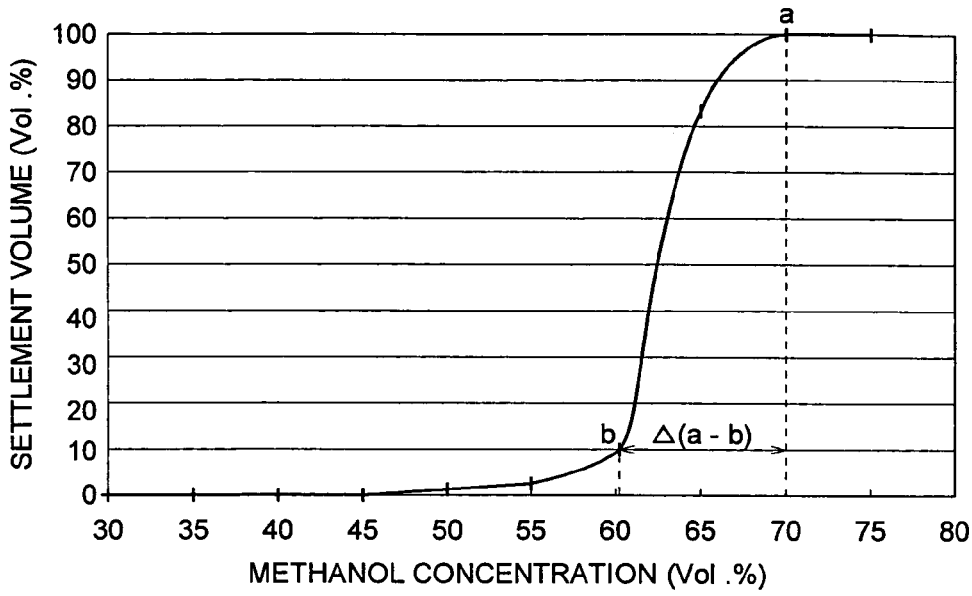
FIG. 1 is a hydrophobicity distribution curve.

A hydrophobicity distribution curve is shown in FIG. 1. In the distribution curve shown in FIG. 1, the methanol concentration at the point a indicates the hydrophobicity, and the difference between the methanol concentration at the point a and the methanol concentration at the point b, that is, Δ(a-b) expresses the hydrophobicity distribution value.

In order to prepare inorganic particles with the degree of hydrophobicity and the hydrophobicity distribution value in said range, it is possible to prepare by carrying out surface treatment using an agent for converting to trimethylsilyl the surface of silica, etc. In particular, it is desirable to use an agent for conversion to trimethylsilyl expressed by the following general equations (1) or (2).

$(CH_3)_3Si)_2NR$ [R in General Equation (1) denotes hydrogen or a lower alkyl radical.] General Equation (1)

$(CH_3)_3SiY$ [In General Equation (2), Y is a radical selected form a halogen atom, —OH, —OR', or —$NR'_2$, where R' is the same as R in General Equation (1) above.] General Equation (2)

It is desirable to use a compound expressed by the above chemical equations. Here, in the above chemical compounds, it is desirable to use as the lower alkyl radical R a methyl radical, ethyl radical, or propyl radical with a carbon number of 1 to 5, more preferably with a carbon number of 1 to 3, and particularly to use a methyl radical. In addition, it is desirable to use as the halogen atom Y either chlorine, fluorine, bromine, or iodine, and chlorine is particularly desirable.

Examples of the agent for conversion to trimethylsilyl indicated by General Equation (1) above are hexamethyldisilazane, N-methyl-hexamethyldisilazane, N-ethyl-hexamethyldisilazane, hexamethyl-N-propyldisilazane, etc., and because of reaction characteristics hexamethyldisilazane is particularly suitable.

On the other hand, examples of the agent for conversion to trialkylsilyl indicated by. General Equation (2) above are trimethylchlorosilane, trimethylsilanol, methoxytrimethylsilane, ethoxytrimethylsilane, propoxytrimethylsilane, dimethylaminotrimethylsilane, diethylaminotrimethylsilane, etc., and because of reaction characteristics trimethylsilanol is particularly suitable.

As the method of surface treatment, it is desirable to make silica and trimethylsilyl conversion agent in the presence of water vapor. At the time this reaction, it is desirable that the surface treatment is carried out with the partial pressure of that water vapor being in the range of 4 to 20 kPa, and more desirably in the range 5 to 15 kPa.

Here, if the partial pressure of water vapor is lower than 4 kPa, the hydrophobicity does not increase, and also the distribution of hydrophobicity becomes wider. On the other hand, even when the partial pressure of water vapor is higher than 20 kPa, the distribution of hydrophobicity becomes wider, and its uniformity is likely to be lost.

Further, for obtaining silica with as high a hydrophobicity as possible in a short reaction time, it is desirable that the above reaction between silica and trimethylsilyl conversion agent is carried out under conditions in which the partial pressure of the vapor phase of the trimethylsilyl conversion agent is in the range 50 to 200 kPa, and more desirably in the range 80 to 150 kPa.

In addition, although the above reaction can be carried out in an environment made up only of trimethylsilyl conversion agent and water vapor, usually, it is very common to supply these to the reaction after diluting with an inert gas such as nitrogen, helium, etc. In that case, usually the total pressure of the reaction environment is in the range 150 to 500 kPa and desirably in the range 150 to 250 kPa.

Further, in order to enhance the reactivity of silica and trimethylsilyl conversion agent, it is also possible, if necessary, to make ammonia, methylamine, dimethylamine, or other basic gases, preferably, ammonia present in the reaction environment. It is preferable that the partial pressure of such basic gas is in the range 1 to 100 kPa.

Considering the satisfactoriness of reactivity of the hydrophobicity enhancement reaction and the dangers of dissociation of the trimethylsilyl conversion agent, it is desirable that the temperature of reaction between silica and trimethylsilyl conversion agent is in the range 130 to 300° C., and more desirably in the range 150 to 250° C. Generally, within this range, there is a trend that the hydrophobicity of the silica obtained is higher when the reaction temperature is higher.

When a polyfunctional silyl conversion agent or a trialkylsilyl conversion agent with a higher carbon number is used other than the above trimethylsilyl conversion agent, it is likely that the hydrophobicity goes down or the hydrophobicity distribution value becomes larger.

Said surface layer includes a binder resin in it for aiding the dispersion of the inorganic particles. It is desirable to use polycarbonates or polyallylates as that binder resin. It is desirable that the molecular numbers of these polycarbonates or polyallylates are in the range 10,000 to 100,000.

In addition, it is desirable that the ratio of inorganic particles in the surface layer in terms of the mass ratio for a mass of 100 of the binder resin is at least a mass of 5 or more but a mass of less than 50. When the mass is less than 5, the wear of the surface layer will be high, and abrasion scratches can be generated thereby making it easy for halftone images to get deformed. At a mass of 50 or more, the surface layer becomes too weak a film and it becomes easy for cracks to be generated.

As for the surface layer according to the present invention, it is desirable to contain an electric charge transport material. As the charge transport material (CTM), a known charge transport material (CTM) can be used. For example, triphenylamines, hydrazones, styryl compound, benzidine compound, butadiene compound can be applied. These charge transport materials are usually dissolved in a proper binder resin to form a layer.

As the mass ratio of binder resin in a surface layer and the charge transport materials, 30 to 200 mass parts of the charge transport materials for 100 mass parts of the binder is preferable, more preferably 50 to 150 mass parts the charge transport materials.

Moreover, it is desirable to make a surface layer contain an antioxidant. By making a surface layer contain an antioxidant and inorganic particles according to the present invention, characteristics change of the surface layer during repeated use can be prevented, fog and a leading end portion density lowering in the counter developing mode can be prevented, and an excellent electrophotography picture image can be offered. The antioxidant is a substance with which as the typical example, action of oxidation for an autoxidation nature substance existing in the organic photoreceptor or on the surface of the organic photoreceptor under light, heat, electric discharging can be prevented.

Following compound can be used as the antioxidant.

(1) Radical Chain Inhibitor

Phenol type antioxidant (e.g. hindered phenols)

Amine type antioxidant (e.g. hindered amines, diallyl diamines, and diallyl amines)

Hydroquinone type antioxidant (2) Peroxide Decomposer

Sulfur type antioxidant (e.g. Thioethers)

Phosphor type antioxidant (e.g. Phosphorous esters)

Radical chain inhibitor is preferably employed among compounds referred above. Hindered phenols and hindered amines antioxidants are particularly preferable. Two or more species of the compounds, for example, a combination of a hindered phenol antioxidant and a thioether antioxidant, may be employed. The antioxidants having a partial structure of hindered phenol, hindered amine, thioether, or phosphite may be employed.

Particularly hindered phenol and hindered amine antioxidants are effective for such improvement of preventing occurrence of fogging and blurring of image in high temperature and high moisture condition.

Content of the antioxidant such as hindered phenol or hindered amine is preferably 0.01 to 20 weight % in the resin layer.

The hindered phenols as described herein means compounds having a branched alkyl group in the ortho position relative to the hydroxyl group of a phenol compound and derivatives thereof. The hydroxyl group may be modified to an alkoxy group.

The hindered amines are compounds having a bulky organic group in the neighborhood of a nitrogen atom, wherein an example of the bulky organic group is a branched alkyl group, and for example t-butyl is preferable. Listed as hindered amines are compounds having an organic group represented by the following structural formula:

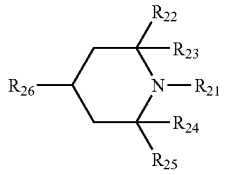

wherein $R_{21}$ represents a hydrogen atom or a univalent organic group, $R_{22}$, $R_{23}$, $R_{24}$, and $R_{25}$ each represents an alkyl group, and $R_{26}$ represents a hydrogen atom, a hydroxyl group, or a univalent organic group.

Listed as antioxidants having a partial hindered phenol structure are compounds described in JP O.P.I. No. 1-118137 (on pages 7 to 14).

Listed as antioxidants having a partial hindered amine structure are compounds described in JP O.P.I. No. 1-118138 (on pages 7 to 9).

Examples of organic phosphor compounds are those represented by a formula of RO—P(OR)—OR, wherein R is a hydrogen atom, an alkyl, alkenyl or aryl group which may have a substituent.

Examples of organic sulfur compounds are those represented by a formula of R—S—OR, wherein R is a hydrogen atom, an alkyl, alkenyl or aryl group which may have a substituent.

Representative antioxidants are listed.

1-1

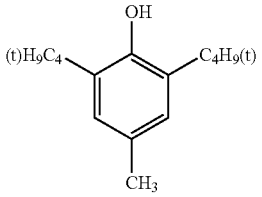

1-2

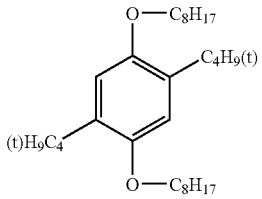

1-3

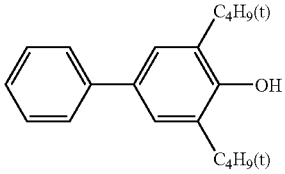

1-4

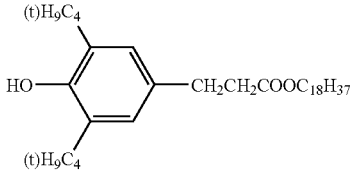

-continued
1-5
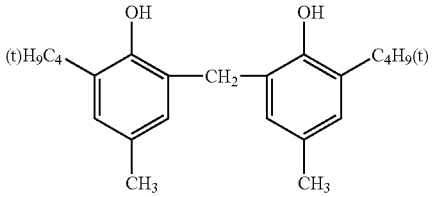
1-6
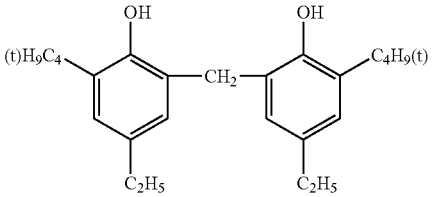
1-7
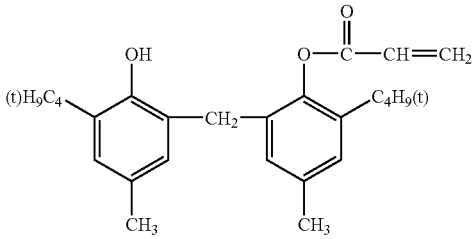
1-8
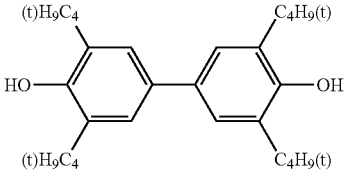
1-9
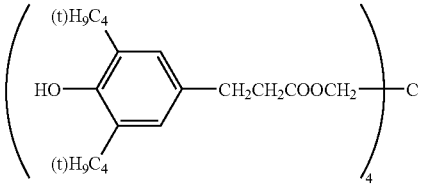
1-10
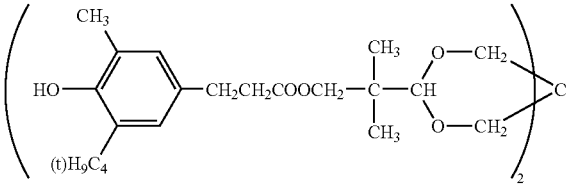
1-11
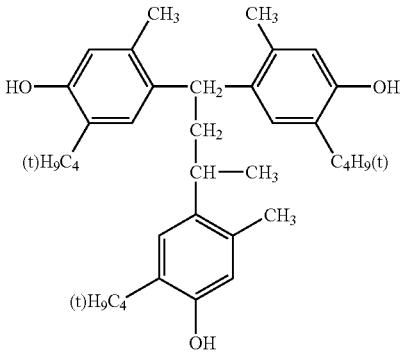
2-1
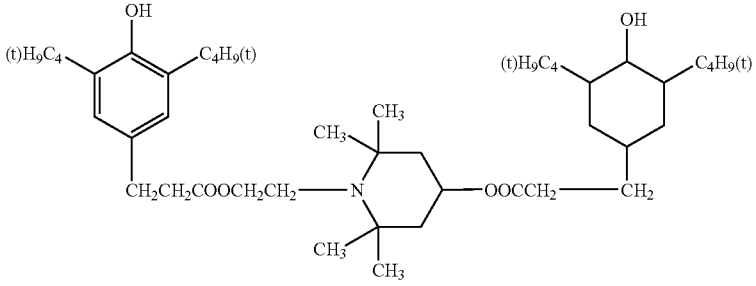

-continued 2-2

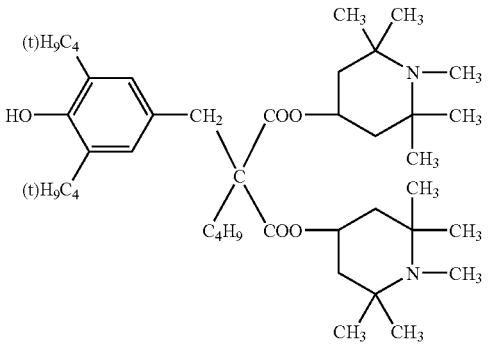

2-3

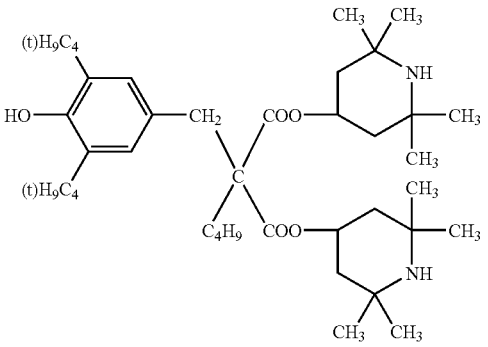

2-4

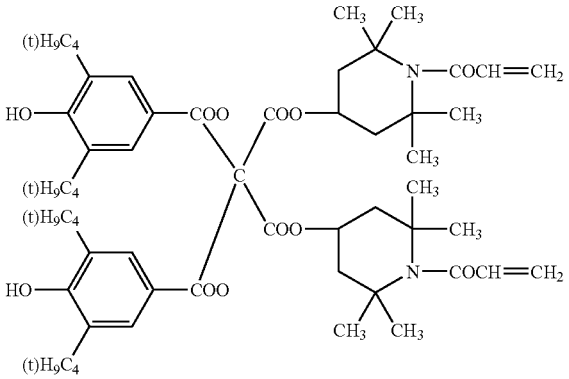

2-5

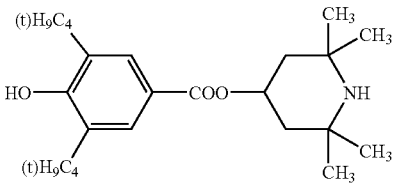

2-6

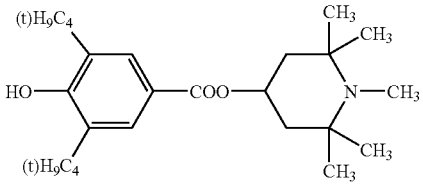

2-7

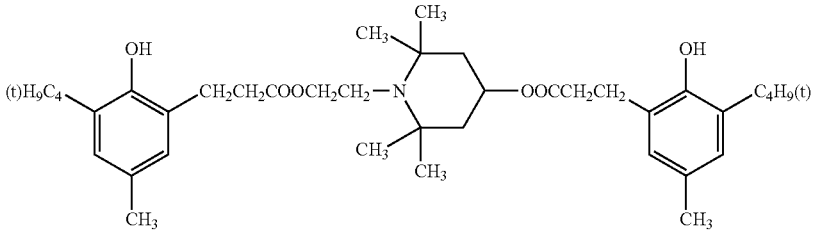

Examples of antioxidant available on the market include the followings.

Hindered phenol type antioxidant: IRGANOX 1076, IRGANOX 1010, IRGANOX 1098, IRGANOX 245, IRGANOX 1330, IRGANOX 3114, IRGANOX 1076, and 3,5-di-t-butyl-4-hydroxybiphenyl.

Hindered amine type antioxidant: SANOL LS2626, SANOL LS765, SANOL LS770, SANOL LS744, TINUVIN 144, TINUVIN 622LD, MARK LA57, MARK LA67, MARK LA62, MARK LA68 and MARK LA63.

Thioether type antioxidant: SUMIRISER TPS, SUMIRISER TP-D.

Phosphite type antioxidant: MARK 2112, MARK PEP-8, MARK PEP-24G, MARK PEP-36, MARK 329K MARK HP-10.

Although in this embodiment, the organic photoreceptor has the surface layer, the following describes the configuration of the organic photoreceptor other than the surface layer.

The organic photoreceptor refers to an electrophotographic photoreceptor equipped with at least one of an electric charge generating function essential to the configuration of the electrophotographic photoreceptor, and an electric charge transport function. It includes all the photoreceptors composed of the commonly known organic charge generating substances or organic charge transfer substances, and the known organic photoreceptors such as the photoreceptor wherein the charge generating function and charge transfer function are provided by the high-molecular complex.

There is no restriction to the configuration of the photoreceptor if the surface layer of the photoreceptor contains the fine particles as described. For example, it includes the following configurations:

1) A configuration wherein the photosensitive layer includes a charge generating layer, and charge transport layer laid sequentially one on top of the other on a conductive support.

2) A configuration wherein the photosensitive layer includes a charge generating layer and the first and second charge transport layers laid sequentially one on top of another on a conductive support.

3) A configuration wherein the photosensitive layer includes a single layer containing a charge transport material and a charge generating material laid on a conductive support.

4) A configuration wherein the photosensitive layer includes a charge transport layer and charge generating layer laid sequentially one on top of the other on a conductive support.

5) A configuration of the photoreceptor described in the aforementioned 1) through 4) wherein a surface protective layer is further provided.

The photoreceptor can be made in any one of the aforementioned configurations. The surface layer of the photoreceptor is the layer in contact with the air boundary. When a single layer photosensitive layer alone is formed on the conductive support, this photosensitive layer corresponds to the surface layer. When a single layer or a laminated photosensitive layer and surface protective layer are laid on the conductive support, the surface protective layer serves as an extreme surface layer. In the photoreceptor, the configuration (2) is most preferably used. In the photoreceptor, a substrate layer may be formed on the conductive support, prior to the formation of the photosensitive layer, independently of the type of configuration adopted.

The charge transport layer can be defined as a layer having a function of transporting the electric charge carrier generated on the charge generating layer due to light exposure, to the surface of the organic photoreceptor. Specific detection of the electric charge transport function can be confirmed by laying the charge generating layer and charge transport layer on the conductive support, and by detecting the photoconductivity.

The following describes a specific configuration of the photosensitive layer, with reference to an example of the layer configuration (2) that is most preferable:

Conductive Support:

A sheet-like or cylindrical conductive support may be used as the conductive support for the photoreceptor. In order to make the image forming apparatus compact, it may be preferable to use a cylindrical conductive support.

The cylindrical conductive support can be defined as a cylindrical support required to form images on an endless basis through rotation. The preferred vertical degree is 0.1 mm or less and deflection is 0.1 mm or less. If the vertical degree and deflection becomes out of the above range, the good image formation becomes difficult.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of 103 Ωcm or less at the normal temperature.

Intermediate Layer:

An intermediate layer equipped with barrier function can be provided between the conductive support and photosensitive layer.

It may be preferable that the intermediate layer used in the present invention contains N-type semi-conductive fine particles. The N-type semiconductive fine particles means that main charge carriers are particles of electrons. That is, since main charge carriers are particles of electrons, the intermediate layer in which the N-type semiconductive fine particles are contained in the insulating binder, effectively blocks the hole injection from the substrate and has a property having less. blocking capability for the electron from the photosensitive layer.

The following describes the method of identifying the N-type semiconducting particles.

An intermediate layer having a film thickness of 5 μm (intermediate layer formed by using a dispersion having 50 wt % of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconducting particles are defined as the particles dispersed in the intermediate layer in cases where the light damping property, when negatively charged in the aforementioned evaluation, is greater than that when positively charged.

The N-type semiconductive particles include the particles of titanium oxide ($TiO_2$), zinc oxide (ZnO) and tin oxide ($SnO_2$), and the titanium oxide is preferable.

As the N-type semiconductive particles, fine particles having the number average primary particle diameter of 3.0 nm to 200 nm, more preferably 5 to 100 nm. The number average primary particle size of the N type semi-conductive fine particles described above is obtained by the following. For example, particles are magnified by a factor of 10,000 according to a transmission electron microscope, and one hundred particles are randomly selected as primary particles from the magnified particles, and are obtained by measuring an average value of the Feret diameter according to image analysis. The intermediate layer using the N-type semiconductive particles where the number average primary particle diameter is within the aforementioned range permits dispersion in the layer to be made more compact, and is provided with sufficient potential stability and black spot preventive function.

Titanium oxide is available in various crystal types such as anatase, rutile and amorphous type. Of these types, the rutile type titanium oxide pigment or anatase type titanium oxide pigment is particularly preferred since it enhances rectifying characteristics of charge through the intermediate layer, i.e., mobility of electron, whereby charge potential is stabilized and generation of transfer memory is prohibited as well as increase of residual potential is prohibited.

As the N-type semiconductive particles, a compound which is a polymer containing a methylhydrogensilixane unit and was subjected to a surface treatment compound is preferably used. The hydrogenpolysiloxane having a molecular weight of from 1,000 to 20,000 is easily available and shows a suitable black spot inhibiting ability, and gives good half tone image.

The polymer containing a methylhydrogensilixane unit is preferably a copolymer of a structural unit of —(HSi($CH_3$)O)— and another siloxane unit. Preferable another siloxane unit is a dimethylsioxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

An intermediate layer coating liquid prepared for forming the intermediate layer employed in the invention is constituted by a binder and a dispersing solvent additional to the surface-treated N-type semiconductor particles.

The ratio of the N-type semiconductor particles to the binder resin in the intermediate layer is preferably from 1.0 to 2.0 times of the binder resin in the volume ratio. By employing the N-type semiconductor particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoreceptor with small potential fluctuation can be prepared. In the intermediate layer, 100 to 200 parts by volume of the N-type semiconductor particles are preferably employed to 100 parts by volume the binder resin.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole-% of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 6

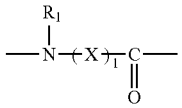

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 7

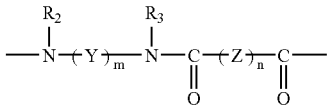

$R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30 for inhibiting the hygroscopic property of the polyamide resin so that the photographic properties, particularly the humidity dependency of the potential on the occasion of the repeating use is made small and the occurrence of the image defects such as the black spots is inhibited without lowering of the solubility of the resin in the solvent for coating.

The carbon number is preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

Number of carbon atoms of polyamide is preferably 7-30, since such polyamide has adequate hygroscopicity and good solubility in solvent for coating composition.

Polyamide resins having a repeating unit structure represented by Formula 7 are preferred.

Formula 5

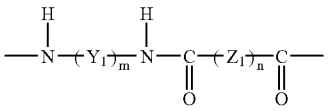

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

Formula 9

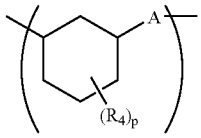

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

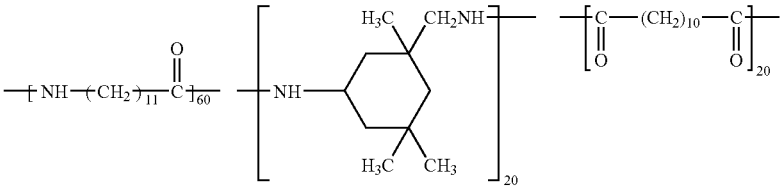

(100%)

N-2

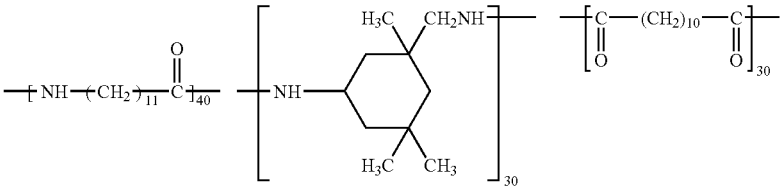

(100%)

N-3

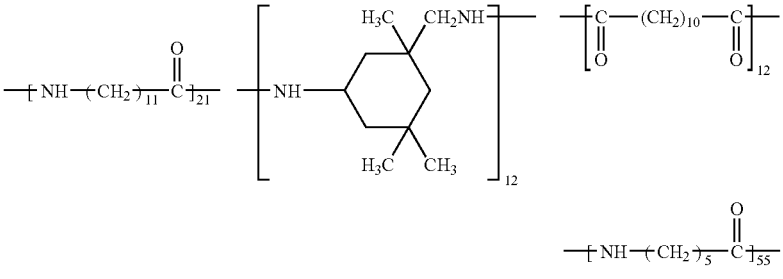

(45%)

N-4

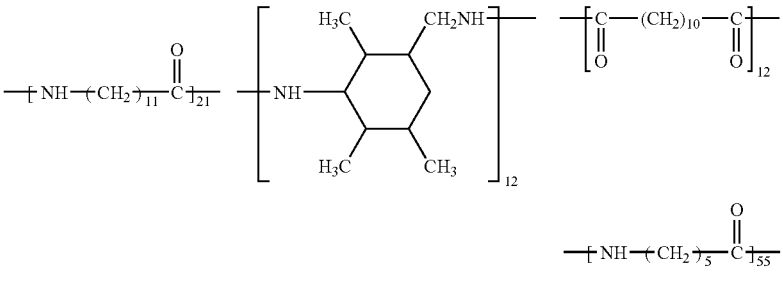

(45%)

-continued
N-5
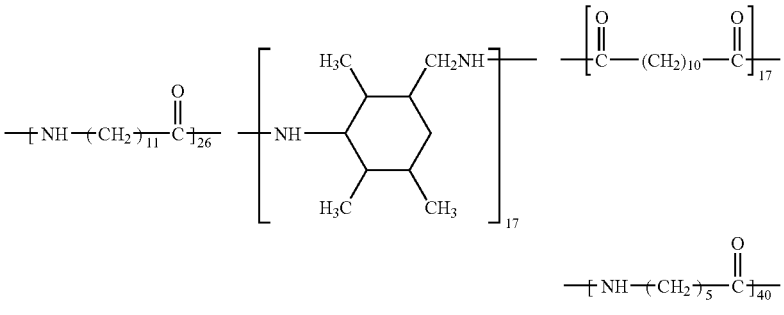
(60%)
N-6
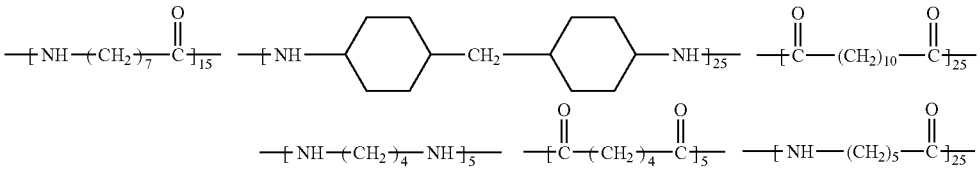
(65%)
N-7
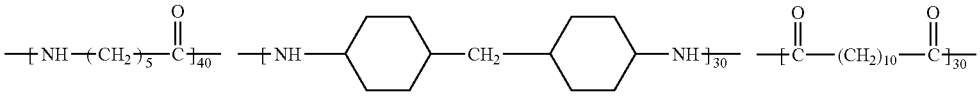
(60%)
N-8
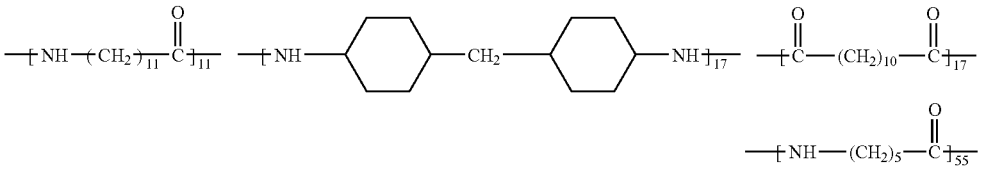
(45%)
N-9
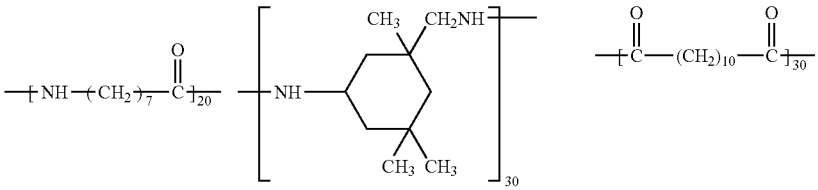
(80%)
N-10
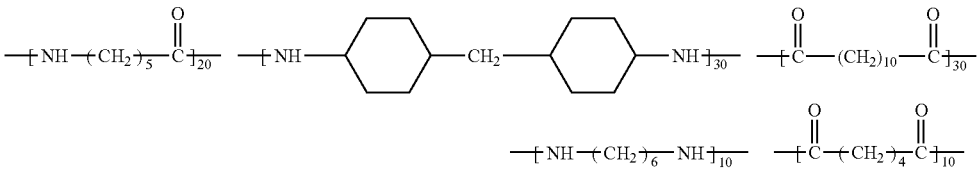
(60%)
N-11
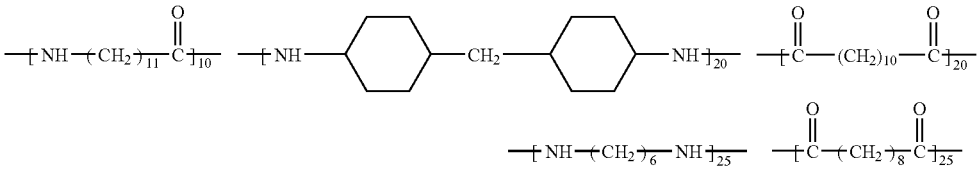
(75%)

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 7 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

The polyamide resin, for example, VESTAMELT X1010 and X4685, manufactured by Daicel.Degussa Ltd., are available in the market, and it is easy to prepare in a usual method. An example of the synthesis method is described.

Synthesis of Exemplified Polyamide Resin N-1

In a polymerization kettle, to which a stirrer, nitrogen, a nitrogen gas introducing pipe, a thermometer and a dehydration tube were attached, 215 parts by weight of lauryllactam, 112 parts by weight of 3-aminomethyl-3,5,5-trimethylcyclohexylamine, 153 parts by weight of 1,12-dodecane dicarboxylic acid and 2 parts by weight of water were mixed and reacted for 9 hours while applying heat and pressure and removing water by distillation. The resultant polymer was taken out and the composition of the copolymer was determined by $C^{13}$-NMR, the composition of the polymer agreed with that of N-11. The melt flow index (MFI) of the above-synthesized copolymer was 5 g/10 min under the condition of 230° C./2.16 kg.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

Thickness of the interlayer is preferably 0.3-10 μm, and more preferably 0.5-5 μm, in view of minimized generation of black spots and non-uniform image at half tone area, inhibiting increase of residual potential and generation of transfer memory, whereby good image having high sharpness can be obtained.

The interlayer is substantially an insulation layer. The volume resistivity of the insulation layer is not less than $1\times10^8$ Ω·cm. The volume resistivity of the interlayer and the protective layer is preferably from $1\times10^8$ to $1\times10^{15}$ Ω·cm, more preferably from $1\times10^9$ to $1\times10^{14}$ Ω cm, and further preferably from $2\times10^9$ to $1\times10^{13}$ Ω·cm. The volume resistivity can be measured as follows.

Measuring condition: According to JIS C2318-1975

Measuring apparatus: Hiresta IP manufactured by Mitsubishi Chemical Corporation.

Measuring condition: Measuring prove HRS

Applied voltage: 500 V

Measuring environment: 30±2° C., 80±5% RH

When volume resistance becomes less than $1\times10^8$, an intermediate layer's electric charge blocking tendency falls, generation of a black spot increases, the potential holdout of an organic photoreceptor also deteriorates, and excellent image quality may be not acquired. On the other hand, when it becomes larger than $10^{15}$ Ω·cm, a residual potential on a repeating image formation will tend to increase, and an excellent image quality will not be acquired.

Photosensitive Layer

The photosensitive layer preferably has a structure in which the functions of the photosensitive layer are separated into a charge generating layer (CGL) and a charge transport layer (CTL) provided on the intermediate layer, even though the photosensitive layer constituted by a single layer structure having both of the charge generation function and the charge transfer function may be applied. By the function separated structure, the increasing of the remaining potential accompanied with repeating use can be inhibited and the other electrophotographic properties can be easily controlled for fitting to the purpose. In the negatively charging photoreceptor, the structure in which the charge generating layer (CGL) is provided on the intermediate layer, and the charge transport layer (CTL) is further provided on the charge generating layer.

The composition of the photosensitive layer of the negatively charging function separated photoreceptor is described below.

Charge Generating Layer

As a charge generating material phthalocyanine pigments, an azo pigment, a perylene pigment, azrenium pigment, etc. can be used.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 mm.

Charge Transport Layer

As described above, the structure which constitutes the charge transport layer from plural charge transport layers and make a charge transport layer of the top layer contain fluorine based resin particles is preferable.

A charge transport layer contains a charge transport material (CTM) and a binder resin for dispersing the CTM and forming a layer. In addition to the fluorine based resin particles, the charge transport layer may contain additives such as an antioxidant agent if necessary.

As a charge transport material (CTM), a known charge transport material (CTM) of the positive hole transportation type (P type) can be used. For example, triphenylamines, hydrazones, styryl compound, benzidine compound, butadiene compound can be applied. These charge transport materials are usually dissolved in a proper binder resin to form a layer.

As the binder resin for charge transport layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly —N— vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by mass to 100 parts of charge transport material by weight.

Total thickness of the CTL is preferably 10-40 μm. Further, the CTL which is positioned at the surface layer is preferably 0.5-10 μm.

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

Moreover, before going into the coating process, in order to remove extraneous matter and coagulum in the coating solution, it is desirable to conduct filtering with a metal filter, a membrane filter, etc for the coating solution of each layer. For example, it is desirable to filter by choosing a pleat type (HDC) by a NihonPall Ltd. company, a depth type (profile), a semi-depth type (profile star), etc. according to the characteristics of a coating solution.

Next, as a coating processing method for manufacturing an organic photoreceptor, the coating processing methods other than slide hopper type coating applicator, such as impregnation coating and spray coating, may be used.

Among the aforesaid coating solution supplying type coating apparatuses, a coating method employing a slide hopper type coating apparatus is most suitable for the occasion to use dispersions in which the low-boiling point solvent is used, as a coating solution, and in the case of a cylindrical photoconductor, it is preferable to coat by using a circular slide hopper type coating apparatus described fully in TOKKAISHO No. 58-189061.

EXAMPLES

Although examples are given and this invention is hereafter explained to details, the aspect of this invention is not limited to this. Incidentally, "part" in the following sentences represents "parts by weight".

Manufacture of Photoreceptor 1

<Intermediate Layer 1>

The cylinder type aluminum support, which surface has 10 points surface roughness Rz of 0.45 μm measured according to regulation of JISB-0601 by subjecting to cutting process and washed, was subjected to coating with the following interlayer coating composition by dipping and thereafter drying under 120 C degree for 30 minutes, an interlayer having dry thickness of 5 μm was prepared.

The following intermediate layer dispersion liquid was diluted twice with the same mixed solvent, and filtered after settling for overnight (filter; Nihon Pall Ltd. company make RIGIMESH 5 μm filter, pressure 50 kPa), whereby the intermediate layer coating solution was produced.

(Preparation of Intermediate Layer Dispersion)

| | |
|---|---|
| Binder resin, exemplified Polyamide N-1) | 1 part |
| Rutile type titanium dioxide (primary particle size of 35 nm; titanium oxide pigment in which surface treatment was performed with dimethyl polysiloxane which has a hydroxyl group at the trailing end, and the degree of hydrophobilization was prepared to 33) | 5.6 parts |
| Ethanol/n-propylalcohol/THF (=45/20/30 by weight) | 10 parts |

The above-mentioned composites were mixed, dispersion was performed for 10 hours by a batch system, using a sand mill homogenizer, and whereby intermediate layer dispersion liquid was produced.

<Charge Generating Layer (CGL)>

| | |
|---|---|
| Charge generating material (CGM): oxi-titanyl phthalocyanine (titanylphthalocyanine which has the maximum diffraction peak at 27.3° of the Bragg angle (2θ ± 0.2°) by X-ray diffraction spectrum with Cu-Kα characteristic-X-rays) | 24 parts |
| Polyvinyl butyral resin "S-LEC BL-1" (made by Sekisui Chemical Co., Ltd.) | 12 parts |
| 2-butanone/cyclohexanone = 4/1 (v/v) | 300 parts |

The above-mentioned compositions were mixed and dispersed using the sand mill, thereby a charge generating layer coating composition was prepared. This coating liquid was applied by a dip coating method on the interlayer, thereby an charge generating layer of 0.5 μm dry film thickness was formed.

<Charge Transport Layer 1 (CTL1)>

| | |
|---|---|
| Charge transportation material (4,4'-dimethyl-4''-(α-phenylstyryl)triphenylamine) | 225 parts |
| Polycarbonate (Z300: manufactured by a Mitsubishi Gas Chemical Company INC. company) | 300 parts |
| Antioxidant (Irganox1010: made by Ciba-Geigy Japan) | 6 parts |
| Dichloromethane | 2000 parts |
| Silicone oil (KF-54: made by Shin-Etsu Chemical Co., Ltd. company) | 1 Part |

The above-mentioned compositions were mixed and dissolved, thereby a charge transport layer coating composition 1 was prepared. This coating composition was coated on the above-mentioned charge generating layer by the immersion coating method, and was subjected to a dry process at 110° C. for 70 minutes, whereby the charge transport layer of 18.0 μm of dried coating layer thickness was formed.

<Charge Transport Layer 2 (CTL2)>

| | |
|---|---|
| Inorganic particles: Silica particles (silica with an average primary particle size of 35 nm for which surface treatment was carried out with hexamethyldisilazane: a degree of hydrophobilization of 72, a degree of hydrophobilization distribution value of 20) | 60 parts |
| Electric Charge transport materials (4,4'-dimethyl-4''-(α-phenylstyryl)triphenylamine) | 150 parts |
| Polycarbonate (Z300: manufactured by a Mitsubishi Gas Chemical Company INC. company) | 300 parts |
| Antioxidant (Irganox1010: made by Ciba-Geigy Japan) | 12 parts |
| THF: Tetrahydrofuran | 2800 parts |
| Silicone oil (KF-54: made by Shin-Etsu Chemical Co., Ltd. company) | 4 Parts |

The above-mentioned compositions were mixed and dissolved, thereby a charge transport layer 2 coating composition was prepared. This coating composition was coated on the above-mentioned charge transport layer by a circular slide hopper type coating apparatus, and was subjected to a dry process at 110° C. for 70 minutes, whereby the charge transport layer of 2.0 μm of dried coating layer thickness was formed and Photoreceptor 1 was prepared.

Production of Photoreceptors 2-6

In production of the photoreceptor 1, photoreceptors 2-6 were produced in the similar way with the photoreceptor 1 except that Rz of conductive support, an intermediate layer, and the type of inorganic particles of a charge transport layer 2 (CTL2) were changed as shown in Table 1.

Manufacture of Photo Conductor 7

The photoreceptor 7 was produced in the similar way with the photoreceptor 1 in the production of a photoreceptor 1 except that Rz of conductive support was set to 0.11 micrometers and the inorganic particles of the charge transport layer 2 (CTL2) were removed.

TABLE 1

| | | | Charge transport layer 2 | | | | | | |
|---|---|---|---|---|---|---|---|---|---|
| Photo No. | Rz (μm) of conductive support | Int. layer No. | Inorganic particles | Surface treatment of inorganic particle | Number average primary particle diameter (nm) | degree of hydrophobilization | degree of hydrophobilization distribution | Added parts of inorganic particles (parts) | Ra (μm) |
| 1 | 0.45 | 1 | 1 | 1 | 35 | 72 | 20 | 60 | 0.008 |
| 2 | 0.45 | 2 | 1 | 1 | 4 | 76 | 19 | 60 | 0.002 |
| 3 | 0.88 | 3 | 1 | 1 | 140 | 52 | 24 | 60 | 0.018 |
| 4 | 0.45 | 4 | 2 | 2 | 60 | 55 | 23 | 60 | 0.007 |
| 5 | 0.45 | 5 | 3 | 1 | 80 | 62 | 20 | 60 | 0.009 |
| 6 | 0.45 | 6 | 1 | 2 | 35 | 67 | 14 | 60 | 0.008 |
| 7 | 0.11 | 1 | None | — | — | — | — | — | 0.0003 |

In Table 1, the inorganic particles 1 represents a silica, the inorganic particles 2 represents an alumina and the inorganic particles 3 represents a titanium oxide. Moreover, about the surface treatment 1 and 2 for inorganic particles, these surface treatments use the following finishing agent.

Surface treatment 1; hexa methyldi silazane

Surface treatment 2; trimethyl silanol

Incidentally, the degree of hydrophobilization and the degree of hydrophobilization distribution value of the inorganic particles used for the photoreceptors 1-6 were adjusted by changing the condition of the surface treatment (such as a partial pressure of water vapor, a partial pressure of a finishing agent, a total pressure, and a reaction temperature) as well as the finishing agent of inorganic particles.

Moreover, the content of the intermediate layer in Table 1 is listed in Table 2.

TABLE 2

| | Intermediate layer | | | | | | | | |
|---|---|---|---|---|---|---|---|---|---|
| | Kind of N-type semiconductive particle and surface treatment | | | Binder resin | | | | | |
| Intermediate layer No. | Kind of particle | Primary particle diameter (nm) | Surface treatment | Kind | Melting heat (J/g) | Percentage of absorption (mass %) | Ratio of unit structure having carbon number larger than 7 (mol %) | Volume ratio Vn/Vb | Layer thickness (μm) |
| 1 | A1 | 35 | *1 | N-1 | 0 | 1.9 | 100 | 1 | 3 |
| 2 | A1 | 35 | *2 | N-2 | 0 | 2 | 100 | 0.7 | 3 |
| 3 | A1 | 35 | *3 | N-3 | 0 | 2.8 | 45 | 1 | 3 |
| 4 | A2 | 35 | *4 | N-1 | 0 | 1.9 | 100 | 1 | 5 |

TABLE 2-continued

| | Intermediate layer | | | | | | | | |
|---|---|---|---|---|---|---|---|---|---|
| | Kind of N-type semiconductive particle and surface treatment | | | Binder resin | | | | | |
| Intermediate layer No. | Kind of particle | Primary particle diameter (nm) | Surface treatment | Kind | Melting heat (J/g) | Percentage of absorption (mass %) | Ratio of unit structure having carbon number larger than 7 (mol %) | Volume ratio Vn/Vb | Layer thickness (μm) |
| 5 | A2 | 35 | *5 | N-1 | 0 | 1.9 | 100 | 2.3 | 10 |
| 6 | A1 | 35 | *6 | N-1 | 0 | 1.9 | 100 | 1 | 1 |

In Table 2,
A1 is rutile type titanium dioxide,
A2 is an anatase form titanium oxide,
*1 is a copolymer (molar ratio 1:1) of methyl hydrogen siloxane and dimethyl siloxane,
*2 is a copolymer (molar ratio 9:1) of methyl hydrogen siloxane and dimethyl siloxane,
*3 is a copolymer (molar ratio 2:8) of methyl hydrogen siloxane and dimethyl siloxane,
*4 is a copolymer (molar ratio 1:1) of methyl hydrogen siloxane and diethyl siloxane,
*5 is a copolymer (molar ratio 1:1) of methyl hydrogen siloxane and methyl ethyl siloxane, and
*6 is methyl hydrogen polysiloxane.

The intermediate layer volume ratio in Table 2 was obtained by changing the ratio (Vn/Vb) of the volume of binder resin and the volume of N type semiconductive particles on a condition that the sum total volume of the volume of binder resin of all of the intermediate layers and the volume of N type semiconductive particles in Photoreceptors 1-7.

Incidentally, in Table 2, surface treatment shows the substance used for the surface treatment performed on the surface of particles.

The heat of fusion and the water absorbing degree were measured as follows:

Measurement of Heat of Fusion

Measuring apparatus: Shimadzu Flow Rate Differential Scanning Calorimeter DSC-50 Manufactured by Shimadzu Corporation.

Measuring condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

Measuring Condition of Water Absorption Degree

The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the Table 2, "Ratio of structural unit having 7 or more carbon atoms" is the ratio in mole-% of the structural unit having 7 or more carbon atoms between the amide bonds in the structural unit.

Evaluation 1 <by a Counter Developing Mode>

The obtained photoreceptors were mounted on a commercial full color compound machine 8050 (a full color compound machine 8050, made by Konica Minolta Camera Business Technologies, of a tandem type using an intermediate transfer member is modified into a counter developing mode and the following process condition) and a cleaning means shown in FIG. 6 was mounted as a cleaning device for a photoreceptor. The surface energy lowering agents (below-mentioned A-D) and a solid resin of below-mentioned E (a solid resin of polycarbonate without the surface energy fall-off effect) and Photoreceptors were combined as shown in Table 3, a color image evaluation was performed by using each color toner of Y, M, C, and Br. A continuous copy was conducted on A4 size copy sheet with an original image having a white background portion, a solid image portion, a halftone image portion and a character image portion and copy images were evaluated. More concretely, at a starting time and each 5000$^{th}$ copy sheet, copy images to be evaluated was sampled and the total 300,000 copy sheets were evaluated. Evaluation items and evaluation criteria are indicated bellow.

Evaluation Condition

As process conditions for a counter developing mode, Evaluation 1 was conducted by the use of the following conditions.

Peripheral speed of photoreceptor: 280 mm/sec

Magnetic brush bent depth (Bsd); 0.30 mm

Developing gap (Dsd); 0.28 mm

Alternate-current component of developing bias (Vac): 1.0 KVp-p

Peripheral speed ratio of a developing sleeve and a photoreceptor (Vs/Vopc): 2.0

Direct-current component of developing bias (Vdc): −500 V

Difference between the surface potential V0 of photoreceptor and the direct-current component Vdc of developing bias (|V0−Vdc|): 200 V Frequency: 5 kHz Duty ratio: 50% in a rectangular wave In the image evaluation, print is conducted under a room temperature.

Developing: Two-component developer using polymerized toner which has average particle diameter of 6.5 micrometers and contains an external additive agent of 0.3 micrometers hydrophobic titanium oxide and 15 nm hydrophobic silica was respectively used for yellow toner, magenta toner, cyan toner, and black toner of respective developing means (4Y, 4M, 4C, 4Br).

Reversal Development Method

Kind of surface energy lowering agent

A; Solid lubricant of zinc stearate

B; Solid lubricant of aluminum stearate

C; Solid lubricant of aluminium oleate

D; Solid lubricant in which fine particles of polytetrafluoroethylene were formed in the shape of a solid (fine particles of polytetrafluoroethylene were made to distribute in thermoplastic macromolecule and was made into the shape of a solid, and a content of polytetrafluoroethylene was 65% of the whole)

E; Solid resin of polycarbonate (with no surface energy fall-off effect)

(1) Image Evaluation

Image Density

An image density on a copy sheet at a starting time and a 30,000$^{th}$ copy sheet were measured by the use of a densitometer "RD-918" (made by Macbeth Corp.) as a relative density in which an image density on a printer copy sheet was set to be 0.0.

AA: 1.3 or more/very good

A: 1.0 to 1.3/a level with which there is no problem for a practical use

C: less than 1.0/there is a problem for a practical use Fog

A fog density on a copy sheet at a starting time and a 300000$^{th}$ copy sheet were measured by the use of a densitometer "RD-918" (made by Macbeth Corp.) as a relative density in which a reflection density on a A4-size copy sheet was set to be 0.000 as to a fog density.

AA: less than 0.010 (very good)

A: 0.010 to 0.020 (a level with which there is no problem for a practical use)

C: 0.020 or more (there is a problem for a practical) A leading section image density lowering A halftone image was produced on a 300,000$^{th}$ copy sheet and evaluated.

AA: A leading section image density lowering was not observed and the halftone image was reproduced clearly. (very good)

A: Although the halftone image was reproduced clearly, there was a leading section image density lowering less than 0.04 in reflection density. (there is no problem for a practical)

C: There was a leading section image density lowering of 0.04 or more in reflection density on the halftone image. (there is a problem for a practical)

Toner Scattering

AA: There are dramatically few toner scattering, and the sharpness of a character picture image is excellent (excellent).

A: Although there is a toner scattering slightly, even character picture image of three points can be judged (practical use is possible).

C: There are many toner scattering, and some character picture images of three points cannot be judged.

Color Reproducibility

Color on solid image portions of secondary color (red, blue and green) in each toner image of Y, M, and C on images of a first printed sheet and a 100$^{th}$ printed sheet by the use of "MacbethColor-Eye7000" and the color difference of the solid image on the first printed sheet and the 100$^{th}$ printed sheet was calculated by the use of a CMC (2:1) color difference formula.

SA: The color difference was smaller than 3 (excellent)

C: The color difference was larger than 3 (it was problematic practically and a practical use was not permissible)

Results are shown in Table 3.

TABLE 3

| Combination No. | Photoreceptor No. | Kind of surface energy lowering agent | Image density | Fog | Leading end portion density lowering | Toner scattering | Color reproducibility |
|---|---|---|---|---|---|---|---|
| 1 | 1 | A | AA | AA | AA | AA | AA |
| 2 | 2 | A | AA | AA | AA | AA | AA |
| 3 | 3 | A | AA | AA | AA | AA | AA |
| 4 | 4 | A | AA | AA | AA | AA | AA |
| 5 | 5 | A | AA | AA | AA | AA | AA |
| 6 | 6 | A | AA | AA | AA | AA | AA |
| 7 | 7 | A | AA | A | A | A | A |
| 8 | 1 | B | AA | AA | AA | AA | AA |
| 9 | 1 | C | AA | AA | AA | AA | AA |
| 10 | 1 | D | AA | AA | A | A | A |
| 11 | 1 | E | AA | C | C | C | C |

As can be seen from Table 3, in the image evaluation conducted in the counter developing mode, Combination Nos. 1-10 in which surface energy lowering agents were supplied onto the surface of the organic photoreceptors show good characteristic in all evaluation items of the image density, the fog, the leading section image density lowering, the toner scattering and the color reproducibility. Especially, Combination Nos. 1-6, 8 and 9 in which photoreceptors which had the surface layer containing inorganic particles having a number average primary diameter of 3 to 150 nm and the surface roughness Ra of 0.002 to 0.018 were used and the surface energy lowering agent was a fatty acid metal salt are excellent in improvement effect. On the other hand, Combination No. 11 in which the surface energy lowering agent was not supplied, the fog, the leading section image density lowering, the toner scattering and the color reproducibility are deteriorated. Further, when the line speed of photoreceptors was a high speed of 330 mm/sec., it was confirmed that all evaluation items of the image density, the fog, the leading section image density lowering, the toner scattering and the color reproducibility show good characteristic.

Evaluation 2 <Evaluation by a Parallel Developing Mode>

The evaluation conducted in Evaluation 1 was conducted with a parallel developing mode in which the moving direction of the photoreceptor was parallel to that of the developing sleeve.

Evaluation Condition

Peripheral speed of photoreceptor: 280 mm/sec

Peripheral speed of a developing sleeve: 560 mm/sec

As a result, the difference like that between the inventive example and the comparative example in Evaluation 1 was not clearly observed, and in comparison with the counter development mode in Evaluation 1 of the present invention, the image density lowered and the electro-photography picture image of a insufficient image density was obtained.

What is claimed is:

1. An image forming apparatus, comprising:

(a) an organic photoreceptor adapted to rotate in a predetermined rotating direction and to form an electrostatic latent image thereon;

(b) a developing device to form a developing brush with a developing agent containing toner on a developing sleeve and to bring the developing brush in contact with the organic photoreceptor at a developing section so as to visualize the electrostatic latent image on the organic photoreceptor to a toner image;

(c) a transfer device to transfer the toner image from the organic photoreceptor to a transfer medium; and (d) an agent supplying device to supply a surface energy lowering agent to the surface of the organic photoreceptor;

wherein the electrostatic latent image is visualized to the toner image while the developing sleeve is rotated in a rotating direction counter to that of the organic photoreceptor at the developing section.

2. The image forming apparatus of claim 1, wherein a surface layer of the organic photoreceptor contains inorganic particles having a number average primary particle diameter of 3 to 150 nm.

3. The image forming apparatus of claim 2, wherein the inorganic particles comprise metal oxides.

4. The image forming apparatus of claim 3, wherein the metal oxides comprise one of silica, alumina and titania.

5. The image forming apparatus of claim 2, wherein the inorganic particles are applied with a surface treatment.

6. The image forming apparatus of claim 1, wherein the photoreceptor has a surface roughness Ra of 0.001 to 0.018 and a ten-point surface roughness of 0.02 to 0.08 μm.

7. The image forming apparatus of claim 1, wherein the developing gap (Dsd) between the photoreceptor and the developing sleeve is 0.2 to 0.6 mm.

8. The image forming apparatus of claim 1, wherein a bent depth (Bsd) of the developing brush at the developing region between the photoreceptor and the developing sleeve is 0 to 0.8 mm.

9. The image forming apparatus of claim 1, wherein the peripheral speed ratio (Vs/Vopc) of the developing sleeve and the photoreceptor is 1.2 to 3.0.

10. The image forming apparatus of claim 1, wherein the peripheral speed ratio (Vs/Vopc) of the developing sleeve and the photoreceptor is 1.5 to. 2.5.

11. The image forming apparatus of claim 1, wherein a difference |Vo-Vdc| between the surface electric potential Vo of the photoreceptor and a direct-current component Vdc of a developing bias is 100 to 300 V, a direct-current component Vdc of a developing bias is -300 V to -650 V, an alternate current component Vac of the developing bias is 0.5 to 1.5 KV, frequency is 3 to 9 KHz, the shape of the alternate current component is a rectangular wave, and a duty ratio is made 45 to 70%, where the duty ratio is the time ratio of the developing side in the rectangular wave.

12. The image forming apparatus of claim 1, further comprising a plurality of image forming units each comprising the organic photoreceptor, the developing device, and the transfer device, wherein the plurality of image forming units form different color toner images each other with different color toner and transfer the different color toner images to the transfer medium.

13. An image forming method, comprising the steps of:

(a) forming an electrostatic latent image on a rotatable organic photoreceptor;

(b) forming a developing brush with a developing agent containing a toner on a rotatable developing sleeve; and (c) visualizing the electrostatic latent image into a toner image with bringing the developing brush in contact with the organic photoreceptor at a developing region while the developing sleeve is rotated in a rotating direction counter to that of the organic photoreceptor at the developing section; and (d) supplying a surface energy lowering agent to a surface of the organic photoreceptor.

14. The image forming method of claim 13, wherein a surface layer of the organic photoreceptor contains inorganic particles having a number average primary particle diameter of 3 to 150 nm.

15. The image forming method of claim 13, wherein the developing gap (Dsd) between the photoreceptor and the developing sleeve is 0.2 to 0.6 mm.

16. The image forming method of claim 13, wherein a bent depth (Bsd) of the developing brush at the developing region between the photoreceptor and the developing sleeve is 0 to 0.8 mm.

17. The image forming method of claim 13, wherein the peripheral speed ratio (Vs/Vopc) of the developing sleeve and the photoreceptor is 1.2 to 3.0.

18. The image forming method of claim 13, wherein the peripheral speed ratio (Vs/Vopc) of the developing sleeve and the photoreceptor is 1.5 to 2.5.

19. The image forming method of claim 13, wherein a difference |Vo-Vdc| between the surface electric potential Vo of the photoreceptor and a direct-current component Vdc of a developing bias is 100 to 300 V. a direct-current component Vdc of a developing bias is −300 V to −650 V. an alternate current component Vac of the developing bias is 0.5 to 1.5 KV, frequency is 3 to 9 KHz, the shape of the alternate current component is a rectangular wave, and a duty ratio is made 45 to 70%, where the duty ratio is the time ratio of the developing side in the rectangular wave.

20. The image forming method of claim 2, wherein the degree of hydrophobicity of inorganic particles is 50 or more.

21. The image forming method of claim 20, wherein the hydrophobicity distribution value of inorganic particles is 25 or less.

* * * * *